US012071843B2

(12) United States Patent
Johnson et al.

(10) Patent No.: US 12,071,843 B2
(45) Date of Patent: Aug. 27, 2024

(54) HOT SWAPPABLE FRACTURING PUMP SYSTEM

(71) Applicant: Downing Wellhead Equipment, LLC, Oklahoma City, OK (US)

(72) Inventors: Austin C. Johnson, Edmond, OK (US); Kyle Schultz, Edmond, OK (US); Ronnie Beason, Lexington, OK (US); Nicholas J. Cannon, Washington, OK (US); Justin Robinson, Stillwater, OK (US); Barton Hickie, Oklahoma City, OK (US)

(73) Assignee: DOWNING WELLHEAD EQUIPMENT, LLC, Oklahoma City, OK (US)

( * ) Notice: Subject to any disclaimer, the term of this patent is extended or adjusted under 35 U.S.C. 154(b) by 0 days.

(21) Appl. No.: 18/174,788

(22) Filed: Feb. 27, 2023

(65) Prior Publication Data

US 2023/0243249 A1 Aug. 3, 2023

Related U.S. Application Data

(63) Continuation of application No. 17/872,516, filed on Jul. 25, 2022, now Pat. No. 11,591,889, which is a continuation of application No. 17/548,087, filed on Dec. 10, 2021, now Pat. No. 11,396,799, which is a continuation-in-part of application No. 16/436,189, filed on Jun. 10, 2019, now Pat. No. 11,242,950.

(51) Int. Cl.
*E21B 43/26* (2006.01)

(52) U.S. Cl.
CPC ..... *E21B 43/2607* (2020.05)

(58) Field of Classification Search
CPC ..... E21B 43/2607; E21B 43/26; B01F 2101/49; F04B 23/04; F04D 13/12
See application file for complete search history.

(56) References Cited

U.S. PATENT DOCUMENTS 3,560,053 A * 2/1971 Ortloff ..... E21B 43/267 406/14
3,773,438 A * 11/1973 Hall ..... E21B 43/2607 417/345
2014/0277772 A1* 9/2014 Lopez ..... F04D 13/12 700/282
2016/0102537 A1* 4/2016 Lopez ..... E21B 43/26 700/282
2017/0356586 A1* 12/2017 Weinstein ..... E21B 43/2607

* cited by examiner

*Primary Examiner* — Reinaldo Sanchez-Medina
*Assistant Examiner* — Nicole Gardner
(74) *Attorney, Agent, or Firm* — HAYNES AND BOONE, LLP

(57) ABSTRACT

A method, apparatus, and system according to which a discharge manifold is pressurized by at least a first fracturing pump, said discharge manifold being adapted to communicate pressurized fluid to an oil and gas wellbore.

20 Claims, 27 Drawing Sheets

HOT SWAPPABLE FRACTURING PUMP SYSTEM

CROSS REFERENCE TO RELATED APPLICATIONS

This application is a continuation of U.S. patent application Ser. No. 17/872,516 (the "'516 Application"), filed Jul. 25, 2022, the entire disclosure of which is hereby incorporated herein by reference.

The '516 Application is a continuation of U.S. patent application Ser. No. 17/548,087 (the "'087 Application"), filed Dec. 10, 2021, now issued as U.S. Pat. No. 11,396,799, the entire disclosure of which is hereby incorporated herein by reference.

The '087 Application is a continuation-in-part ("CIP") of U.S. patent application Ser. No. 16/436,189 (the "'189 Application"), filed Jun. 10, 2019, the entire disclosure of which is hereby incorporated herein by reference.

BACKGROUND

This application is related generally to oil and gas hydraulic fracturing operations and, more particularly, to a hydraulic fracturing system including a hot swappable fracturing pump system.

DETAILED DESCRIPTION

Figure 1A:
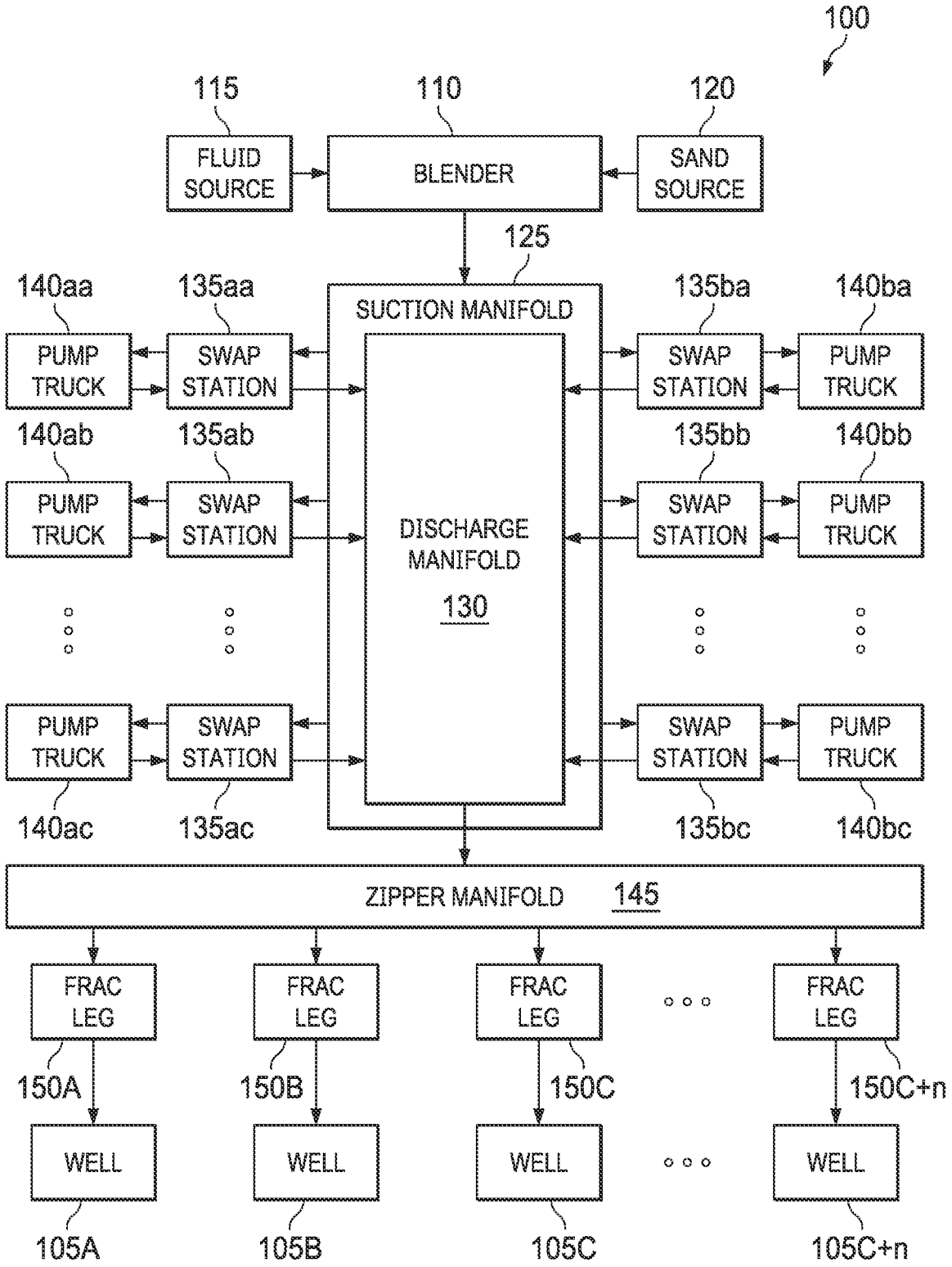
FIG. 1A is a diagrammatic illustration of a hydraulic fracturing system operable to hydraulically fracture one or more oil and gas wells, according to one or more embodiments.

Referring to FIG. 1A, in an embodiment, a hydraulic fracturing system 100 for hydraulically fracturing wells 105A through 105C+n is illustrated, which hydraulic fracturing system 100 includes: a blender 110 adapted to mix fluid from a fluid source 115 with sand from a sand source 120 to produce hydraulic fracturing fluid; a suction manifold 125 adapted to receive the hydraulic fracturing fluid from the blender 110; a discharge manifold 130; a plurality of swap stations 135*aa* though 135*bc*, each adapted to communicate the hydraulic fracturing fluid from the suction manifold 125 to a corresponding pump truck 140*aa* through 140*bc*, and, after pressurization by the corresponding pump truck 140*aa* through 140*bc*, to communicate the pressurized hydraulic fracturing fluid from the corresponding pump truck 140*aa* through 140*bc* to the discharge manifold 130; and a zipper manifold 145 adapted to communicate the pressurized hydraulic fracturing fluid from the discharge manifold 130 to a plurality of hydraulic fracturing legs (or "frac legs") 150A through 150C+n, each of which is adapted to communicate the pressurized hydraulic fracturing fluid from the zipper manifold 145 to a corresponding one of the wells 105A through 105C+n. In one or more embodiments, each of the swap stations 135*aa* through 135*bc* is or includes one or more components shown and described in the '189 Application, filed Jun. 10, 2019, now published as U.S. Patent Application Publication No. 2020/0386359, the entire disclosure of which is hereby incorporated herein by reference.

Although shown in FIG. 1A as including the swap stations 135*aa* through 135*ac* and the corresponding pumps trucks 140*aa* through 140*ac*, the hydraulic fracturing system 100 may additionally (or alternatively) include one or more additional swap stations between the swap stations 135*ab* and 135*ac*, together with one or more additional corresponding pump trucks between the pump trucks 140*ab* and 140*ac*. Likewise, although shown in FIG. 1A as including the swap stations 135*ba* through 135*bc* and the corresponding pumps trucks 140*ba* through 140*bc*, the hydraulic fracturing system 100 may additionally (or alternatively) include one or more additional swap stations between the swap stations 135*bb* and 135*bc*, together with one or more additional corresponding pump trucks between the pump trucks 140*bb* and 140*bc*.

Figure 1B:
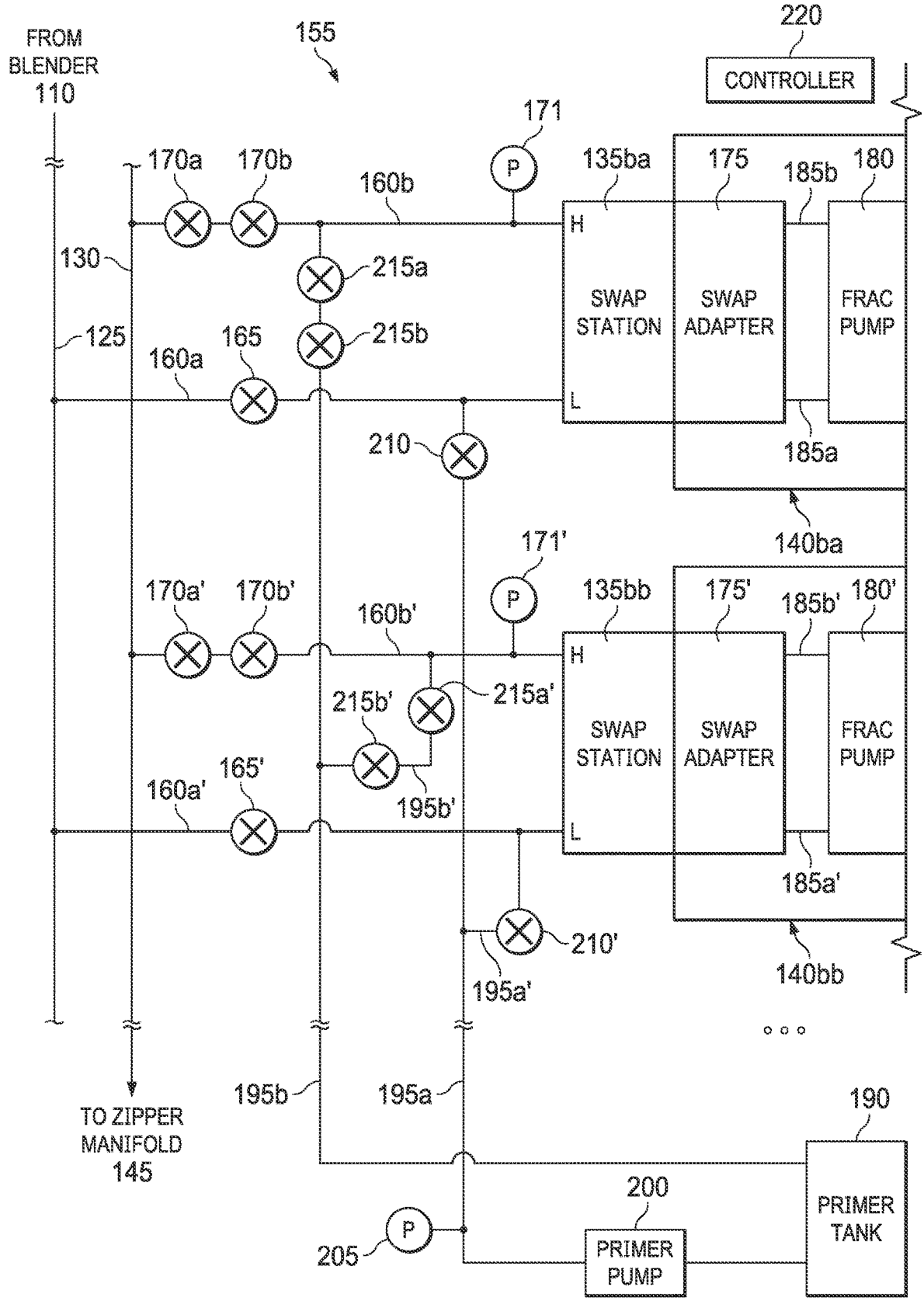
FIG. 1B is a diagrammatic illustration of a portion of the hydraulic fracturing system of FIG. 1A, said portion including a hot swappable fracturing pump system, according to one or more embodiments.

Referring to FIG. 1B, with continuing reference to FIG. 1A, in an embodiment, the hydraulic fracturing system 100 includes a hot swappable fracturing pump system 155, which hot swappable fracturing pump system 155 includes the swap stations 135*ba* and 135*bb*, and the corresponding pump trucks 140*ba* and 140*bb*. The swap station 135*ba* is connected to, and adapted to be in fluid communication with, the suction manifold 125 via a suction conduit 160*a*. The suction conduit 160*a* includes a valve 165 that controls the communication of fluid between the suction manifold 125 and the swap station 135*ba*. In one or more embodiments, the valve 165 is a gate valve. Additionally, the suction conduit 160*a* may include another valve such as, for example, a check valve, in addition to the valve 165. Likewise, the swap station 135*ba* is connected to, and adapted to be in fluid communication with, the discharge manifold 130 via a discharge conduit 160*b*. The discharge conduit 160*b* includes a pair of valves 170*a-b* that control the communication of fluid between the swap station 135*ba* and the discharge manifold 130. In one or more embodiments, the valves 170*a-b* are gate valves. Additionally, the discharge conduit 160*b* may include another valve such as, for example, a check valve, in addition to the valves 170*a-b*. Alternatively, in one or more embodiments, one of the valves 170*a-b* is a check valve. The discharge conduit 160*b* also includes a pressure sensor 171 that detects a discharge pressure exiting the swap station 135*ba*.

The pump truck 140*ba* includes a swap adapter 175 and a fracturing pump 180. The fracturing pump 180 is connected to, and adapted to be in fluid communication with, the swap adapter 175 via a suction conduit 185*a*. Likewise, the fracturing pump 180 is connected to, and adapted to be in fluid communication with, the swap adapter 175 via a discharge conduit 185*b*. In one or more embodiments, the suction conduit 185*a*, the discharge conduit 185, or both is/are or include(s) flexible conduit(s) (e.g., flexible hose(s)). In addition, or instead, the suction conduit 185*a*, the discharge conduit 185, or both may be or include rigid conduit(s), swivel(s) (e.g., chiksan swivel joints), both rigid conduit(s) and swivel(s), the like, or any combination thereof. The swap adapter 175 of the pump truck 140*ba* is detachably connectable to the swap station 135*ba*, as shown in FIG. 1B; when so detachably connected: fluid communication is established between the suction conduit 160*a* and the suction conduit 185*a*; and fluid communication is established between the discharge conduit 185*b* and the discharge conduit 160*b*. In one or more embodiments, the swap adapter 175 includes, or is part of, the swap station 135*ba*.

The hot swappable fracturing pump system 155 also includes a primer tank 190 connected to, and adapted to be in fluid communication with, the suction conduit 160*a* (at a location between the swap station 135*ba* and the valve 165) via a primer conduit 195*a*. The primer conduit 195*a* includes a primer pump 200, a pressure sensor 205, and a valve 210. The primer pump 200 is adapted to pump fluid from the primer tank 190 to the suction conduit 160*a* via the primer conduit 195*a*. The pressure sensor 205 detects a discharge pressure exiting the primer pump 200. The valve 210 controls the communication of fluid between the primer tank 190 and the suction conduit 160*a* (via the primer conduit 195*a*). In one or more embodiments, the valve 210 is a gate valve. Additionally, the primer conduit 195*a* may include another valve such as, for example, a check valve, in addition to the valve 210. Likewise, the primer tank 190 is connected to, and adapted to be in fluid communication with, the discharge conduit 160*b* (at a location between the swap station 135*ba* and the valves 170*a-b*) via a primer conduit 195*b*. The primer conduit 195*b* includes a pair of valves 215*a-b* that control the communication of fluid between the discharge conduit 160*b* and the primer tank 190 (via the primer conduit 195*b*). In one or more embodiments, the valves 215*a-b* are gate valves. Additionally, the primer conduit 195*b* may include another valve such as, for example, a check valve, in addition to the valves 215*a-b*. Alternatively, in one or more embodiments, one of the valves 215*a-b* is a check valve. Although the hot swappable fracturing pump system 155 is described as including the primer tank 190 and the primer pump 200, the primer tank 190, the primer pump 200, or both may instead be omitted in favor of an existing fluid vessel (and, optionally, an associated pump or valve) on the well site, to which existing fluid vessel the primer fluid conduits 195*a-b* are connected.

The swap station 135*bb* is connected to, and adapted to be in fluid communication with, the suction manifold 125 via a suction conduit 160*a*'. The suction conduit 160*a*' includes a valve 165' that controls the communication of fluid between the suction manifold 125 and the swap station 135*bb*. In one or more embodiments, the valve 165' is a gate valve. Additionally, the suction conduit 160*a*' may include another valve such as, for example, a check valve, in addition to the valve 165'. Likewise, the swap station 135*bb* is connected to, and adapted to be in fluid communication with, the discharge manifold 130 via a discharge conduit 160*b*'. The discharge conduit 160*b*' includes a pair of valves 170*a-b*' that control the communication of fluid between the swap station 135*bb* and the discharge manifold 130. In one or more embodiments, the valves 170*a-b*' are gate valves. Additionally, the discharge conduit 160*b*' may include another valve such as, for example, a check valve, in addition to the valves 170*a-b*'. Alternatively, in one or more embodiments, one of the valves 170*a-b*' is a check valve. The discharge conduit 160*b*' also includes a pressure sensor 171' that detects a discharge pressure exiting the swap station 135*bb*.

The pump truck 140*bb* includes a swap adapter 175' and a fracturing pump 180'. The fracturing pump 180' is connected to, and adapted to be in fluid communication with, the swap adapter 175' via a suction conduit 185*a*'. Likewise, the fracturing pump 180' is connected to, and adapted to be in fluid communication with, the swap adapter 175' via a discharge conduit 185*b*'. The swap adapter 175' of the pump truck 140*bb* is detachably connectable to the swap station 135*bb*, as shown in FIG. 1B; when so detachably connected: fluid communication is established between the suction conduit 160*a*' and the suction conduit 185*a*'; and fluid communication is established between the discharge conduit 185*b*' and the discharge conduit 160*b*'.

The primer tank 190 of the hot swappable fracturing pump system 155 is also connected to, and adapted to be in fluid communication with, the suction conduit 160*a*' (at a location between the swap station 135*bb* and the valve 165') via the primer conduit 195*a* and a primer conduit 195*a*'. The primer conduit 195*a*' includes a valve 210'. The primer pump 200 is adapted to pump fluid from the primer tank 190 to the suction conduit 160*a*' via the primer conduit 195*a* and the primer conduit 195*a*'. The valve 210' controls the communication of fluid between the primer tank 190 and the suction conduit 160*a*' (via the primer conduit 195*a* and the primer conduit 195*a*'). In one or more embodiments, the valve 210' is a gate valve. Additionally, the primer conduit 195*a*' may include another valve such as, for example, a check valve, in addition to the valve 210'. Likewise, the primer tank 190 is connected to, and adapted to be in fluid communication with, the discharge conduit 160*b*' (at a location between the swap station 135*bb* and the valves 170*a-b*') via the primer conduit 195 and a primer conduit 195*b*'. The primer conduit 195*b*' includes a pair of valves 215*a-b*' that control the communication of fluid between the discharge conduit 160*b*' and the primer tank 190 (via the primer conduit 195*b* and the primer conduit 195*b*'). In one or more embodiments, the valves 215*a-b*' are gate valves. Additionally, the primer conduit 195*b*' may include another valve such as, for example, a check valve, in addition to the valves 215*a-b*'. Alternatively, in one or more embodiments, one of the valves 215*a-b*' is a check valve.

A controller 220 is adapted to send control signals to, and receive feedback (e.g., position feedback) from, the swap station 135*ba*, the valve 165, the valve 170*a*, the valve 170*b*, the fracturing pump 180, the primer pump 200, the valve 210, the valve 215*a*, the valve 215*b*, the swap station 135*bb*, the valve 165', the valve 170*a*', the valve 170*b*', the fracturing pump 180', the valve 210', the valve 215*a*', the valve 215*b*', or any combination thereof. Additionally, the controller 220 is adapted to receive pressure readings from the pressure sensor 171, the pressure sensor 205, the pressure sensor 171', or any combination thereof. In one or more embodiments, the controller 220 is or includes a non-transitory computer readable medium and one or more processors adapted to execute instructions stored on the non-transitory computer readable medium. In one or more embodiments, the controller 220 is located on-site at the well site. For example, the controller 220 may be part of the swap station 135*ba*. For another example, the controller 220 may be part of the swap station 135*bb*. For yet another example, the controller 220 may be part of the primer pump 200. Alternatively, the controller 220 may be located remotely from the well site. In one or more embodiments, the controller 220 includes a plurality of controllers. In one or more embodiments, the controller 220 includes a plurality of controllers, with one or more controllers located on-site at the well site (e.g., as part of the swap station 135*ba*, the swap station 135*bb*, the primer pump 200, or any combination thereof) and/or one or more other controllers located remotely from the well site. In one or more embodiments, the controller 220 is, includes, or is part of, one or more controllers, sub-controllers, nodes, components, systems, etc. described and illustrated in one or more of the following applications: U.S. patent application Ser. No. 17/388,716, filed Jul. 29, 2021, the entire disclosure of which is hereby incorporated herein by reference; U.S. patent application Ser. No. 17/319,854, filed May 13, 2021, the entire disclosure of which is hereby incorporated herein by reference; U.S. patent application Ser. No. 16/855,749, filed Apr. 22, 2020, the entire disclosure of which is hereby incorporated herein by reference.

In a first operational state or configuration of the hot swappable fracturing pump system 155: the pump truck 140*ba* is not connected to the swap station 135*ba* via the swap adapter 175; the pump truck 140*bb* is connected to the swap station 135*bb* via the swap adapter 175'; and the fracturing pump 180' of the pump truck 140*bb* draws fluid from the suction manifold 125 and discharges pressurized fluid to the discharge manifold 130. More particularly, the valves 210' and 215*a-b*' are closed and the valve 165' is opened to permit fluid to be drawn from the suction manifold 125 by the fracturing pump 180' (via the suction conduit 160*a*', the valve 165', the swap station 135*bb*, the swap adapter 175', and the suction conduit 185*a*'). Additionally, the valves 170*a-b*' are opened to permit pressurized fluid to be discharged into to the discharge manifold 130 by the fracturing pump 180' (via the discharge conduit 185*b*', the swap adapter 175', the swap station 135*bb*, the discharge conduit 160*b*', and the valves 170*a-b*'). The valves 165, 170*a-b*, 210, and 215*a-b* corresponding to the swap station 135*ba* are closed in the first operational state or configuration.

Subsequently, in a second operational state or configuration of the hot swappable fracturing pump system 155: the pump truck 140*ba* is connected to the swap station 135*ba* via the swap adapter 175, as shown in FIG. 1B; and the fracturing pump 180 is primed by the primer pump 200 using fluid from the primer tank 190. More particularly, the valve 210 is opened to permit the primer pump 200 to supply fluid from the primer tank 190 to the fracturing pump 180 (via the primer conduit 195*a*, the valve 210, the suction conduit 160*a*, the swap station 135*ba*, the swap adapter 175, and the suction conduit 185*a*). Additionally, the valves 215*a-b* are opened to permit circulation of fluid from the fracturing pump 180 back to the primer tank 190 during the priming process (via the discharge conduit 185*b*, the swap adapter 175, the swap station 135*ba*, the discharge conduit 160*b*, the primer conduit 195*b*, and the valves 215*a-b*). While the hot swappable fracturing pump system 155 transitions from the first operational state or configuration to the second operational state or configuration, the fracturing pump 180' of the pump truck 140*bb* continues to draw fluid from the suction manifold 125 and discharge pressurized fluid to the discharge manifold 130, as described above.

Subsequently, in a third operational state or configuration of the hot swappable fracturing pump system 155, once the fracturing pump 180 is fully primed (as confirmed by pressure readings from the pressure sensors 171 and 205), the fracturing pump 180 of the pump truck 140*ba* is brought on line to draw fluid from the suction manifold 125 and discharge pressurized fluid to the discharge manifold 130. More particularly, the valve 165 is opened and the valve 210 is closed to permit the fracturing pump 180 to draw fluid from the suction manifold 125 (via the suction conduit 160*a*, the valve 165, the swap station 135*bb*, the swap adapter 175, and the suction conduit 185*a*). In one or more embodiments, the valve 165 is opened before the valve 210 is closed. In one or more embodiments, the valves 165 and 210 are simultaneously opened and closed, respectively. Additionally, the valves 170*a-b* are opened and the valves 215*a-b* are closed to permit the fracturing pump 180 to discharge pressurized fluid to the discharge manifold 130 (via the discharge conduit 185, the swap adapter 175, the swap station 135*ba*, the discharge conduit 160*b*, and the valves 170*a-b*). In one or more embodiments, the valves 170*a-b* are opened before the valves 215*a-b* are closed. In one or more embodiments, the valves 170*a-b* and 215*a-b* are simultaneously opened and closed, respectively. While the hot swappable fracturing pump system 155 transitions from the second operational state or configuration to the third operational state or configuration, the fracturing pump 180' of the pump truck 140*bb* continues to draw fluid from the suction manifold 125 and discharge pressurized fluid to the discharge manifold 130, as described above.

Finally, in a fourth operational state or configuration of the hot swappable fracturing pump system 155, the fracturing pump 180' of the pump truck 140*bb* is brought off line for maintenance and/or repair. More particularly, the fracturing pump 180' is ramped down, the valves 170*a-b'* are closed, and the valves 215*a-b'* are opened to bleed off residual pressure in the discharge conduits 160*b'* and 185*b'* to the primer tank 190. Additionally, the valve 165' is closed, and, optionally, the valve 210' is opened to bleed off residual pressure in the suction conduits 160*a'* and 185*a'* to the primer tank 190. Once the residual pressure in the discharge conduits 160*b'* and 185*b'* and, optionally, the suction conduits 160*a'* and 185*a'*, is bled off to the primer tank 190, the valves 210' and 215*a-b'* are closed and the swap adapter 175' of the pump truck 140*bb* is disconnected from the swap station 135*bb*. While the hot swappable fracturing pump system 155 transitions from the third operational state or configuration to the fourth operational state or configuration, the fracturing pump 180 of the pump truck 140*ba* continues to draw fluid from the suction manifold 125 and discharge pressurized fluid to the discharge manifold 130, as described above. A replacement pump truck substantially identical to the pump truck 140*bb* with a replacement fracturing pump substantially identical to the fracturing pump 180' may subsequently be connected to the swap station 135*bb*, via a replacement swap adapter substantially identical to the swap adapter 175', and brought on line in a manner similar to that described above with respect to the pump truck 135*ba* and the fracturing pump 180.

Although described as including the swap stations 135*ba* and 135*bb*, and the corresponding pump trucks 140*ba* and 140*bb*, the hot swappable fracturing pump system 155 may additionally or alternatively include any other combination of the swap stations 135*aa* through 135*bc*, and the corresponding pump trucks 140*aa* and 140*bc*, together with the primer tank 190, the primer pump 100, corresponding conduits substantially identical to the conduits 160*a-b* and 195*a-b* (or 195*a-b'*), corresponding valves substantially identical to the valves 165, 170*a-b*, 210, and 215*a-b* (or 165', 170*a-b'*, 210', and 215*a-b'*), and corresponding pressure sensors substantially identical to the pressure sensors 171 (or 171') and 205. The operation of the various corresponding components of such a system would be substantially identical to that described above with respect to the hot swappable fracturing pump system 155 shown in FIG. 1B and, therefore, will not be described in further detail.

In one or more embodiments, the swap stations 135*aa* though 135*bc* are substantially identical to one another, and, therefore, in connection with FIGS. 2A, 2B, and 5A through 7C, only the swap station 135*ba* will be described in detail below; however, the description below applies equally to the swap stations 135*aa* through 135*ac*, 135*bb*, and 135*bc*. Additionally, in one or more embodiments, the pump trucks 140*aa* through 140*bc* are substantially identical to one another, and, therefore, in connection with FIGS. 2A, 2B, 3, and 4A through 4C, only the pump truck 140*ba* will be described in detail below; however, the description below applies equally to the pump trucks 140*aa* through 140*ac*, 140*bb*, and 140*bc*.

Figure 2A:
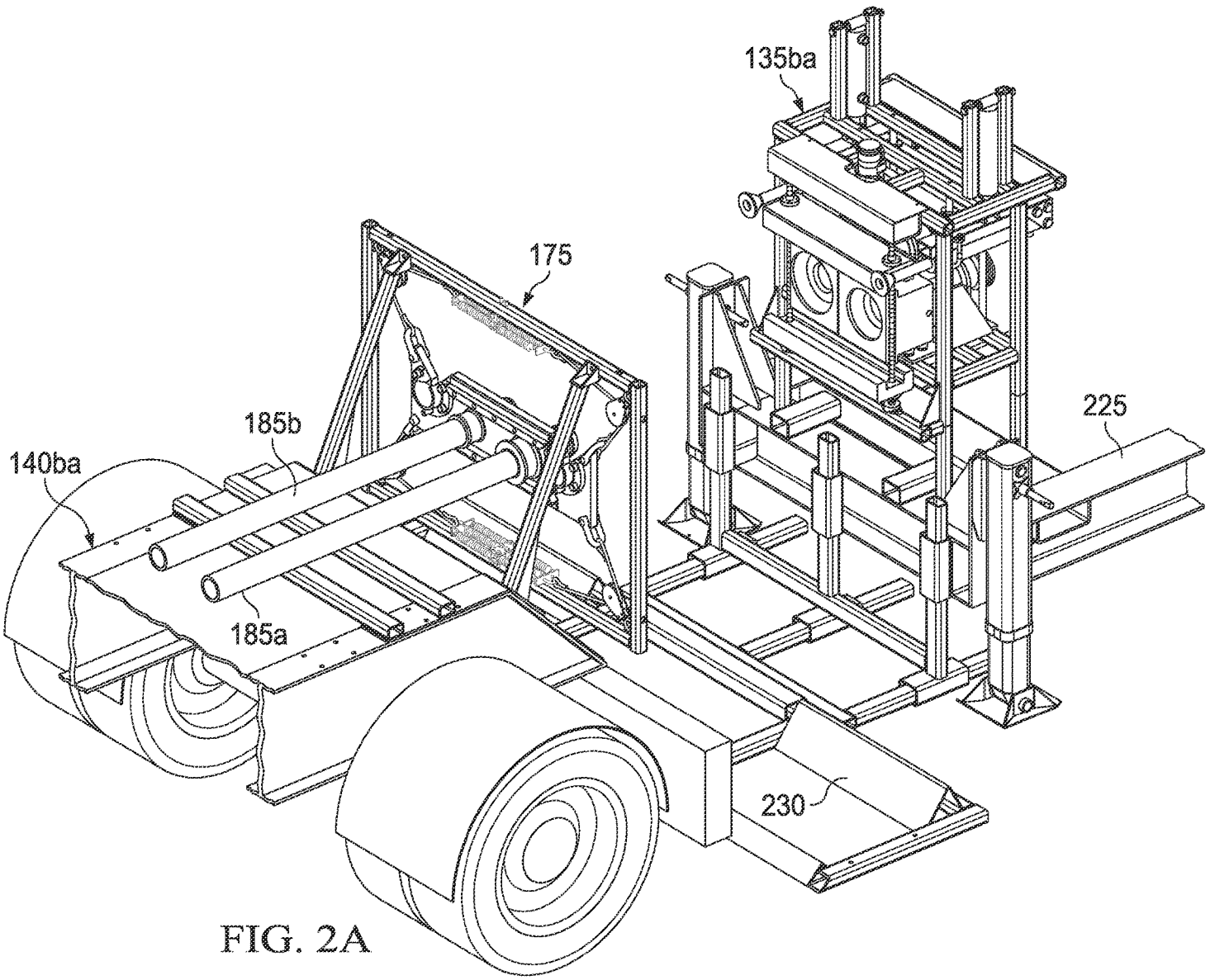
FIG. 2A is a perspective view of a swap station and a pump truck of the hot swappable fracturing pump system of FIG. 1B, according to one or more embodiments.
Figure 2B:
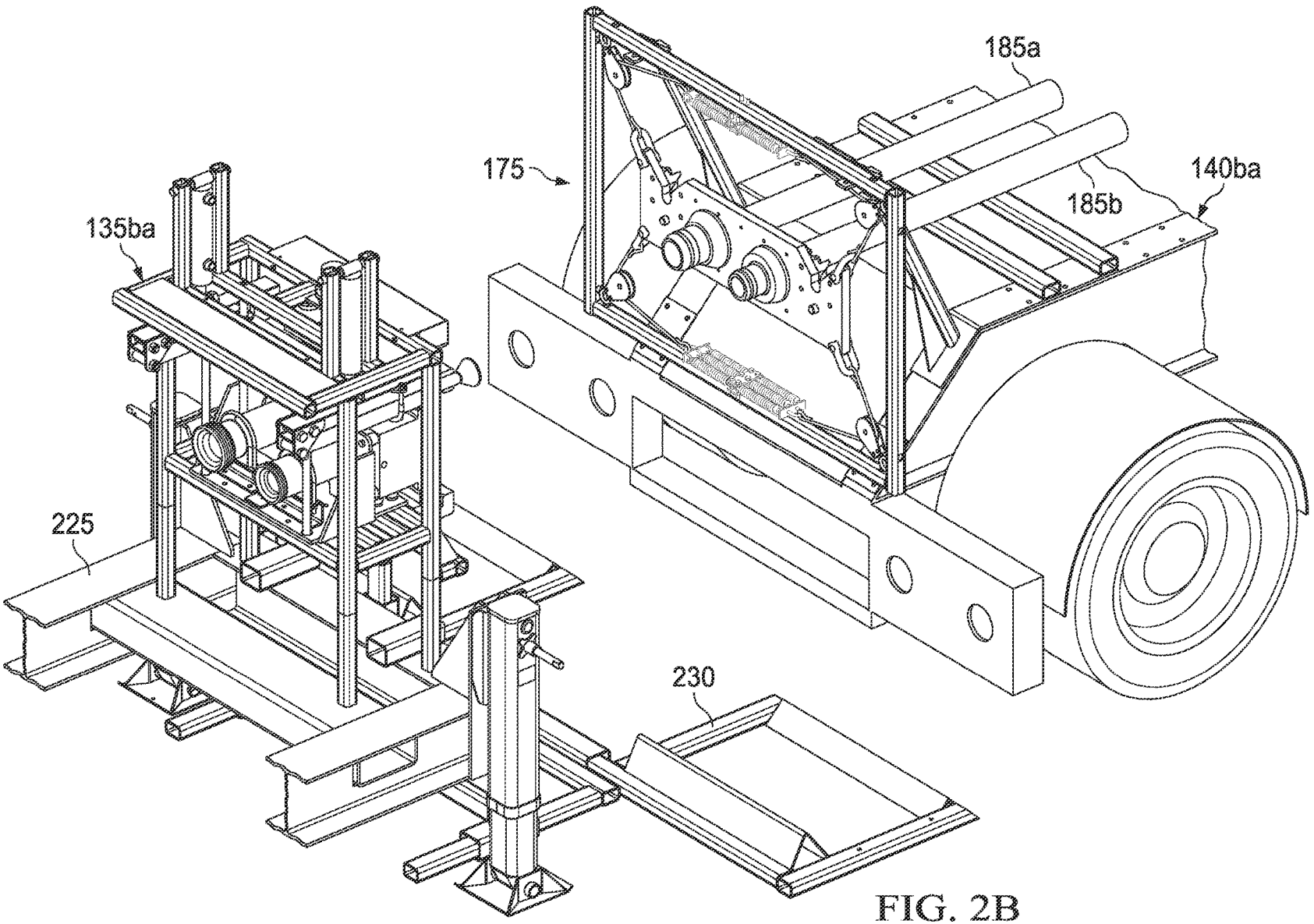
FIG. 2B is another perspective view of the swap station and the pump truck of the hot swappable fracturing pump system of FIG. 1B, according to one or more embodiments.

Referring to FIGS. 2A and 2B, with continuing reference to FIGS. 1A and 1B, in an embodiment, the suction conduit 185*a* and the discharge conduit 185*b* are connected to, and extend from the swap adapter 175, which swap adapter 175 is connected to the pump truck 140*ba*. The swap station 135*ba* is supported by a skid 225. A chock assembly 230 is connected to, and extends from, the skid 225 along the ground. The chock assembly 230 assists a driver of the pump truck 140*ba* in backing the pump truck 140*ba* into a position relative to the swap station 135*ba*, in which position the swap station 135*ba* is capable of grappling the swap adapter 175, as will be described in further detail below.

Figure 3:
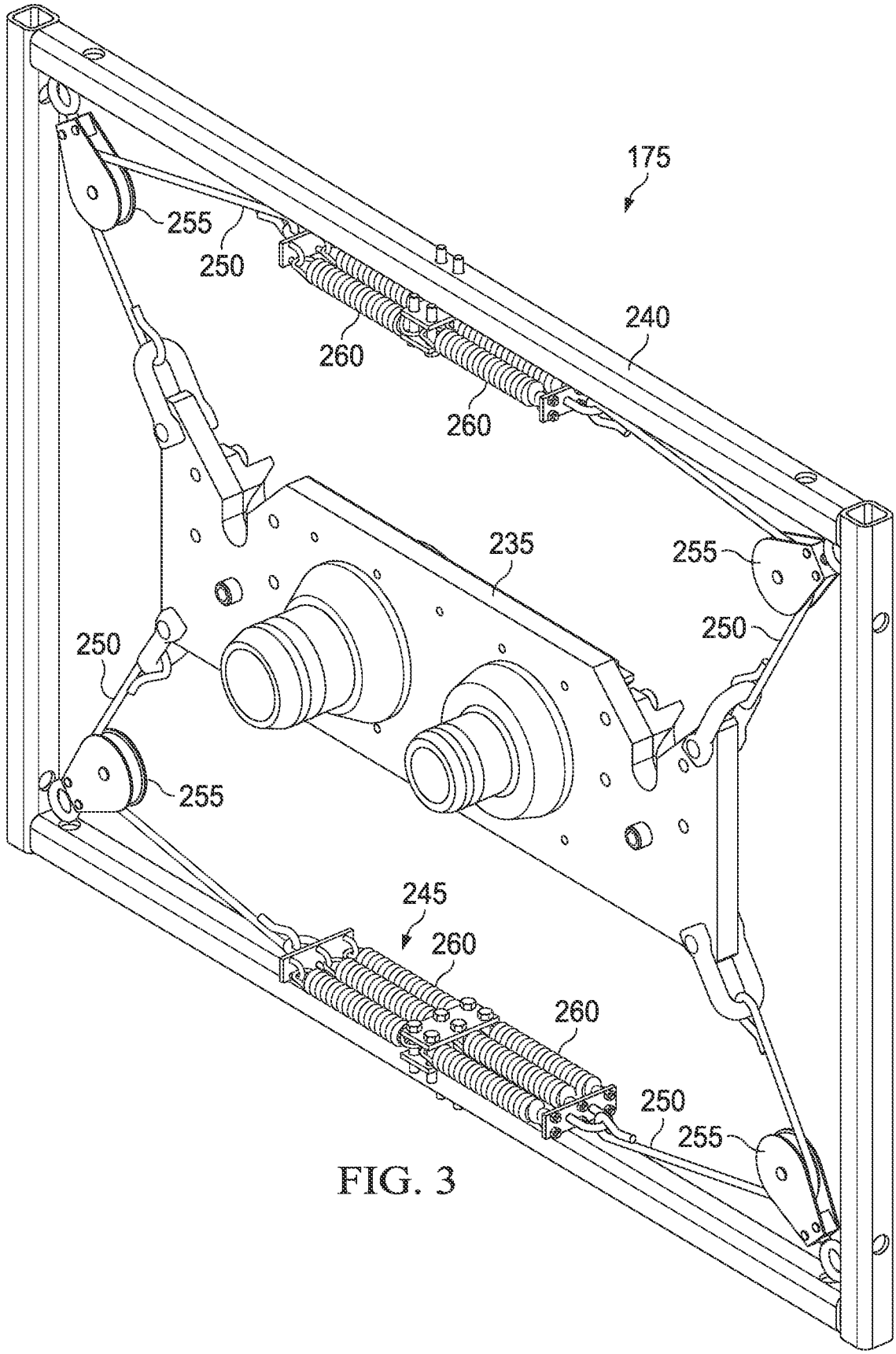
FIG. 3 is a perspective view of a swap adapter connected to the pump truck of FIGS. 2A and 2B, according to one or more embodiments.

Referring to FIG. 3, with continuing reference to FIGS. 2A and 2B, in an embodiment, the swap adapter 175 of the pump truck 140*ba* includes an adapter body 235 and an adapter frame 240. The adapter frame 240 is generally rectangular in shape. The adapter body 235 is suspended within the adapter frame 240 by a suspension assembly 245. In one or more embodiments, the suspension assembly 245 includes a plurality of lines 250, each of which is connected at one end to the adapter body 235, extends through a corresponding pulley 255 anchored to the adapter frame 240, and is connected at the other end to a spring 260, or springs 260, anchored to the adapter frame 240. In addition, or instead, the adapter body 235 may be suspended within the adapter frame 240 by another suitable suspension assembly.

Figure 4A:
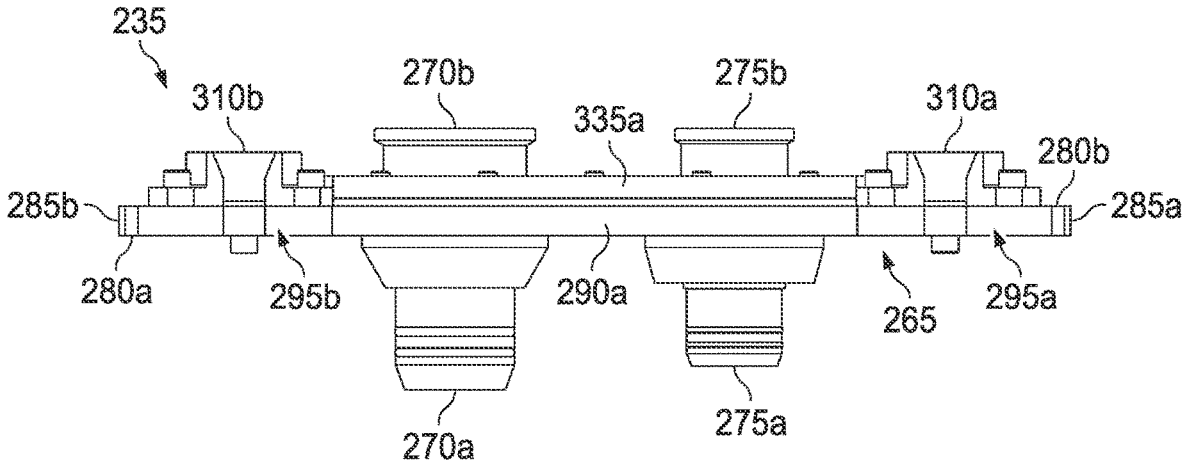
FIG. 4A is a top plan view of an adapter body of the hot swap adapter of FIG. 3, according to one or more embodiments.
Figure 4B:
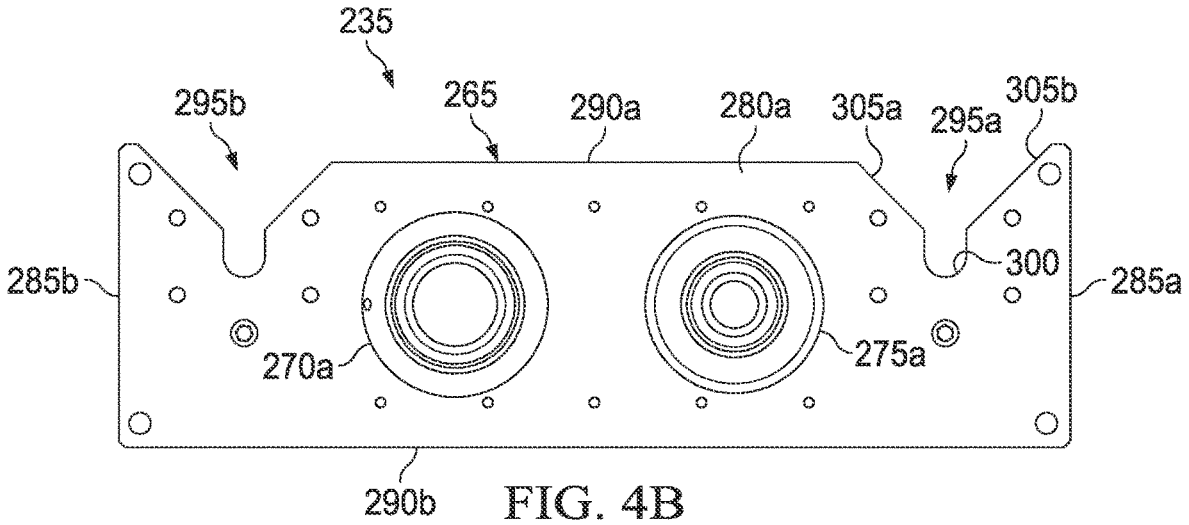
FIG. 4B is an elevational view of the adapter body of the swap adapter of FIG. 3, according to one or more embodiments.
Figure 4C:
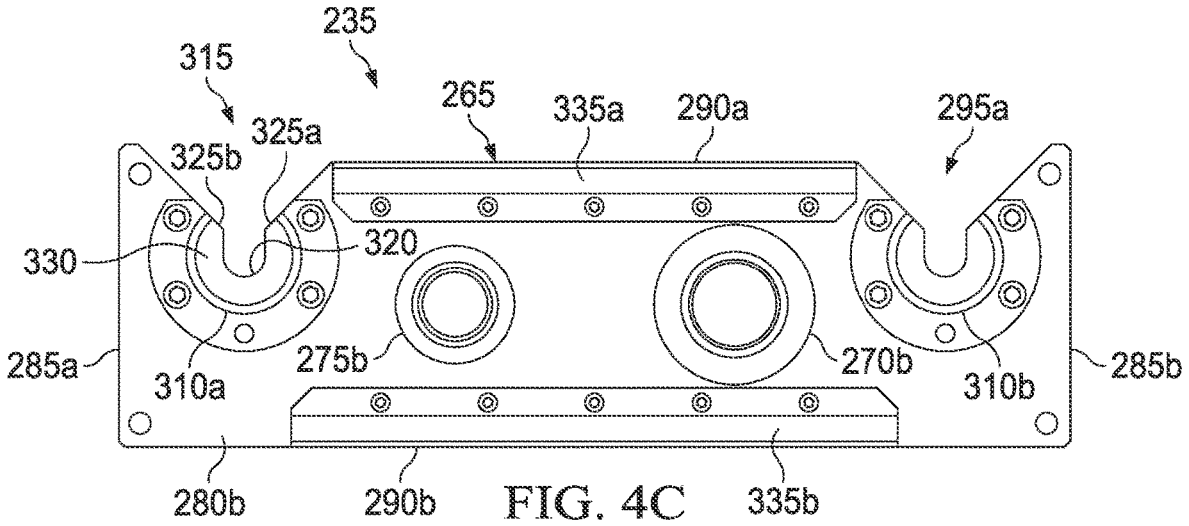
FIG. 4C is another elevational view of the adapter body of the swap adapter of FIG. 3, according to one or more embodiments.

Referring to FIGS. 4A through 4C, with continuing reference to FIG. 3, the adapter body 235 includes an adapter plate 265, suction fittings 270*a-b*, and discharge fittings 275*a-b*. The adapter plate 265 is generally rectangular in shape and defines opposing side portions 280*a-b*, opposing widthwise edge portions 285*a-b*, and opposing lengthwise edge portions 290*a-b*. Both the suction fitting 270*a* and the discharge fitting 275*a* extend from the side portion 280*a* of the adapter plate 265. Likewise, both the suction fitting 270*b* and the discharge fitting 275*b* extend from the side portion 280*b* of the adapter plate 265. The suction conduit 185*a* is connected to, and extends from, the suction fitting 270*a* (as shown in FIGS. 2A and 2B). Additionally, the discharge conduit 185*b* is connected to, and extends from, the discharge fitting 270*b* (as shown in FIGS. 2A and 2B).

A recess 295*a* is formed widthwise into the lengthwise edge portion 290*a* of the adapter plate 265, proximate the widthwise edge portion 285*a*. As shown in FIG. 4B, the recess 295*a* defines a slot 300 and opposing inclined surfaces 305*a-b* in the adapter plate 265, which opposing inclined surfaces 305*a-b* extend from the slot 300 toward the lengthwise edge portion 290*a*. A grappling hold 310*a* is connected to, and extends from, the side portion 280*b* of the adapter plate 265 proximate the recess 295*a*. A recess 315 is formed into the grappling hold 310*a*. The recess 315 defines a slot 320 and opposing inclined surfaces 325*a-b* in the grappling hold 310*a*, which opposing inclined surfaces 325*a-b* extend from the slot 320. The grappling hold 310*a* also includes a tapered (e.g., frustoconical) surface 330 adjacent the slot 320. The grappling hold 310*a* is connected to the side portion 280*b* of the adapter plate 265 in a manner that aligns the slot 320 and the opposing inclined surfaces 325*a-b* of the grappling hold 310*a* with the slot 300 and the opposing inclined surfaces 305*a-b*, respectively, of the adapter plate 265. Similarly, a recess 295*b* is formed widthwise into the lengthwise edge portion 290*a* of the adapter plate 265, proximate the widthwise edge portion 285*b*. The recess 295*b* is substantially identical to the recess 295*a*, and, therefore, will not be described in further detail. Additionally, a grappling hold 310*b* is connected to, and extends from, the side portion 280*b* of the adapter plate 265 proximate the recess 295*b*. The grappling hold 310*b* is substantially identical to the grappling hold 310*a*, and, therefore, will not be described in further detail.

A clamping hold 335*a* is connected to, and extends from, the side portion 280*b* of the adapter plate 265 along the lengthwise edge portion 290*a*. Likewise, a clamping hold 335*b* is connected to, and extends from, the side portion 280*b* of the adapter plate 265 along the lengthwise edge portion 290*b*.

Figure 5A:
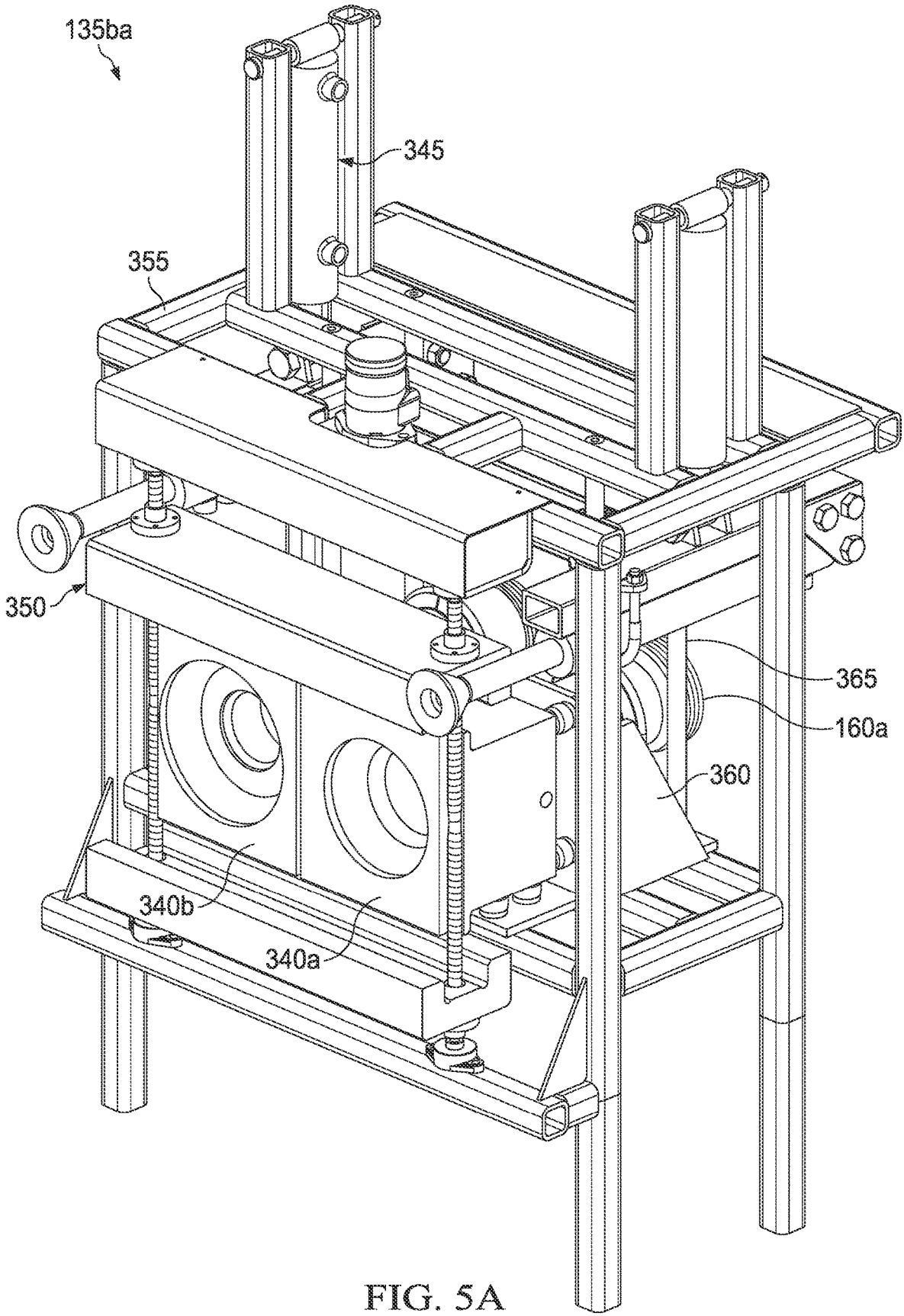
FIG. 5A is a perspective view of the swap station of FIGS. 2A and 2B, according to one or more embodiments.
Figure 5B:
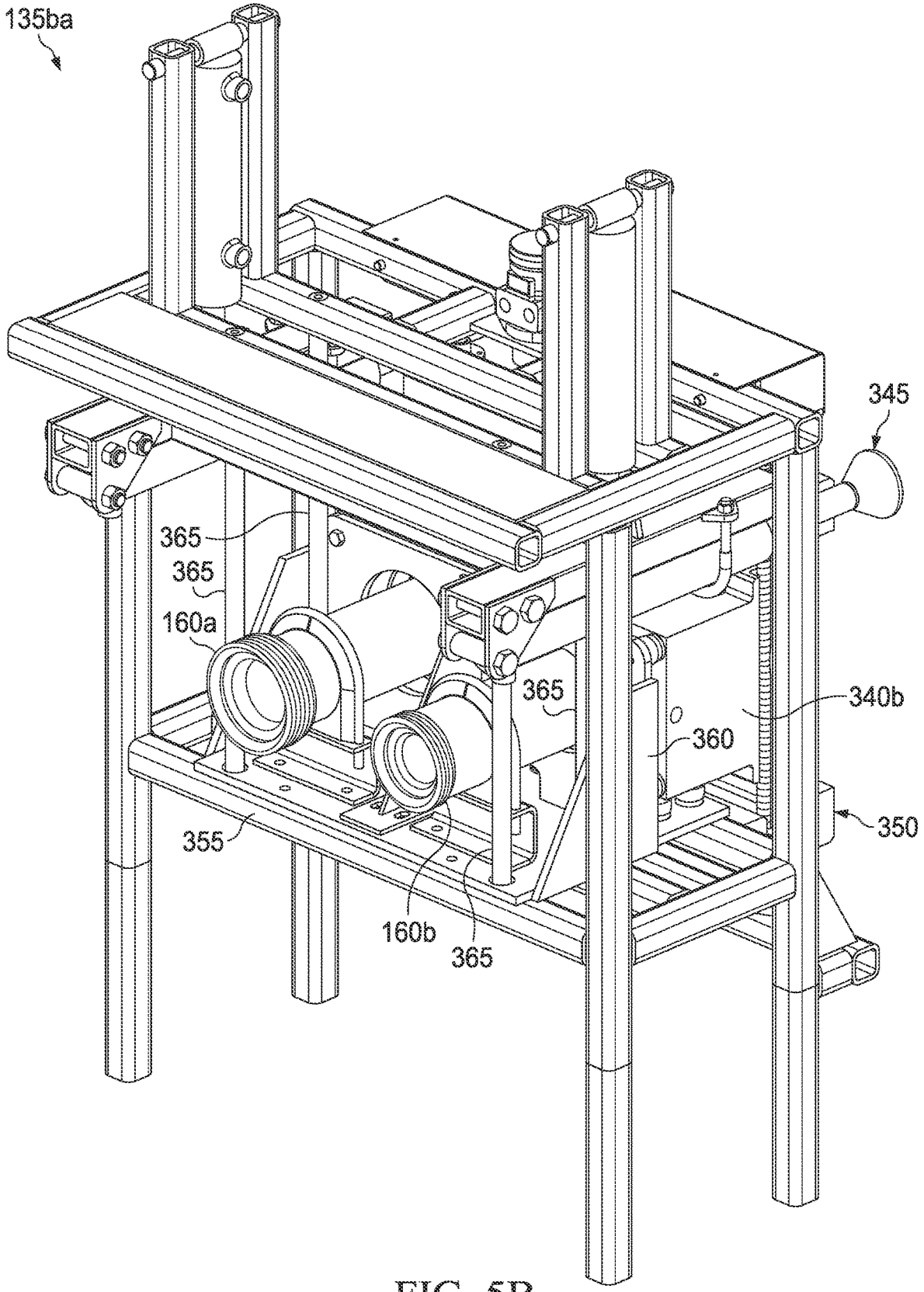
FIG. 5B is another perspective view of the swap station of FIGS. 2A and 2B, according to one or more embodiments.
Figure 5C:
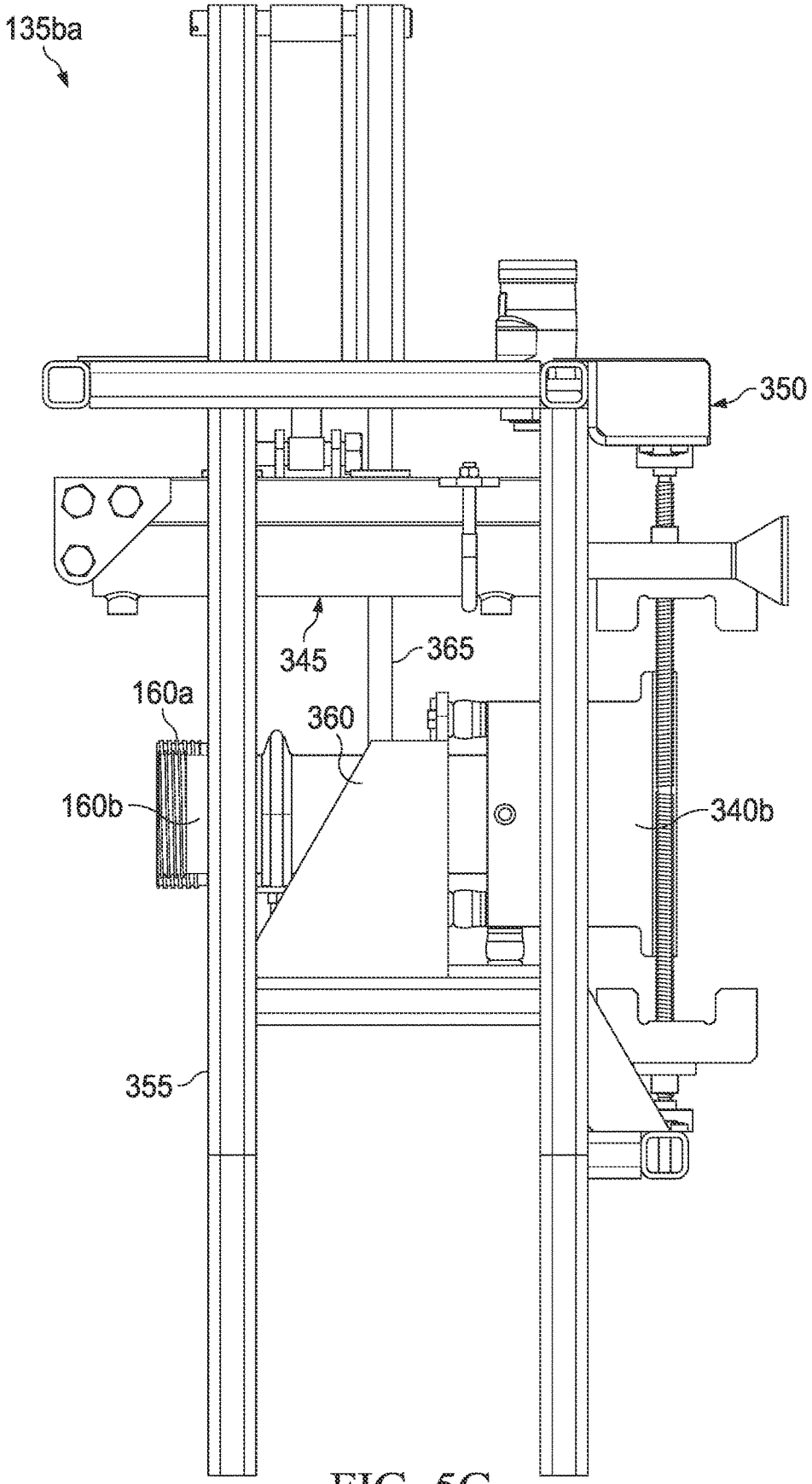
FIG. 5C is an elevational view of the swap station of FIGS. 2A and 2B, according to one or more embodiments.

Referring to FIGS. 5A through 5C, with continuing reference to FIGS. 2A and 2B, in an embodiment, the swap station 135*ba* includes a suction flow component 340*a*, a discharge flow component 340*b*, a grapple assembly 345, a lock assembly 350, and a support frame 355. The suction flow component 340*a* and the discharge flow component 340*b* are anchored to the support frame 355 using a support bracket 360. The suction conduit 160*a* is connected to, and extends from, the suction flow component 340*a*. Likewise, the discharge conduit 160*b* is connected to, and extends from, the discharge flow component 340*b*. The grapple assembly 345 is also connected to the support frame 355. A plurality of guide rods 365 are also connected to the support frame 355 to guide the grapple assembly 345 within a range of motion (e.g., a vertical range of motion). The lock assembly 350 is anchored to the support frame 355 proximate the suction flow component 340*a* and the discharge flow bock 340*b*, and is adapted to engage the suction flow component 340*a* and the discharge flow component 340*b* to thereby secure the suction fitting 270*a* and the discharge fitting 275*a* of the swap adapter 175 to the suction flow component 340*a* and the discharge flow component 340*b*, respectively, of the swap station 135*ba*.

Figure 6A:
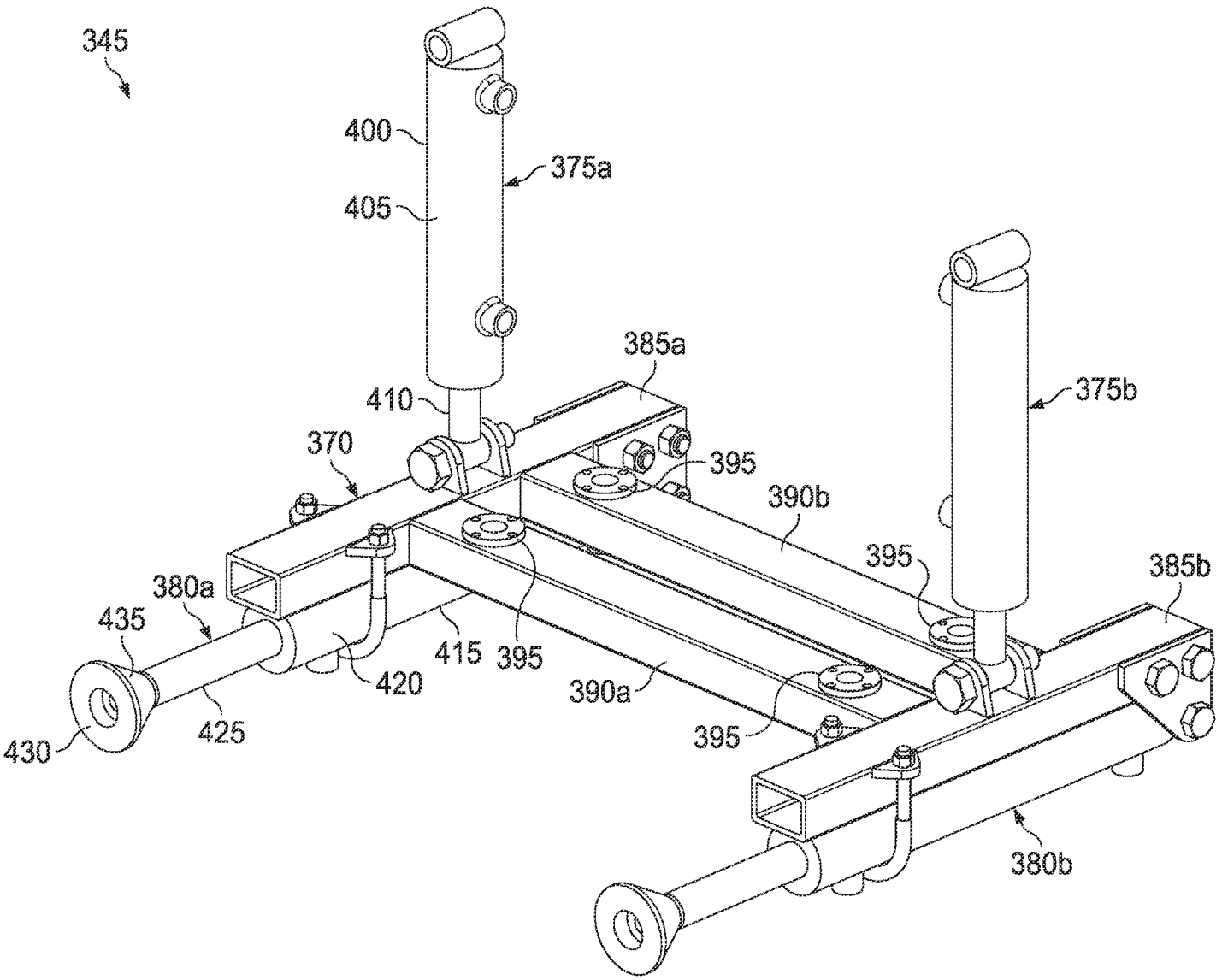
FIG. 6A is a perspective view of a grapple assembly of the swap station of FIGS. 5A through 5C, according to one or more embodiments.
Figure 6B:
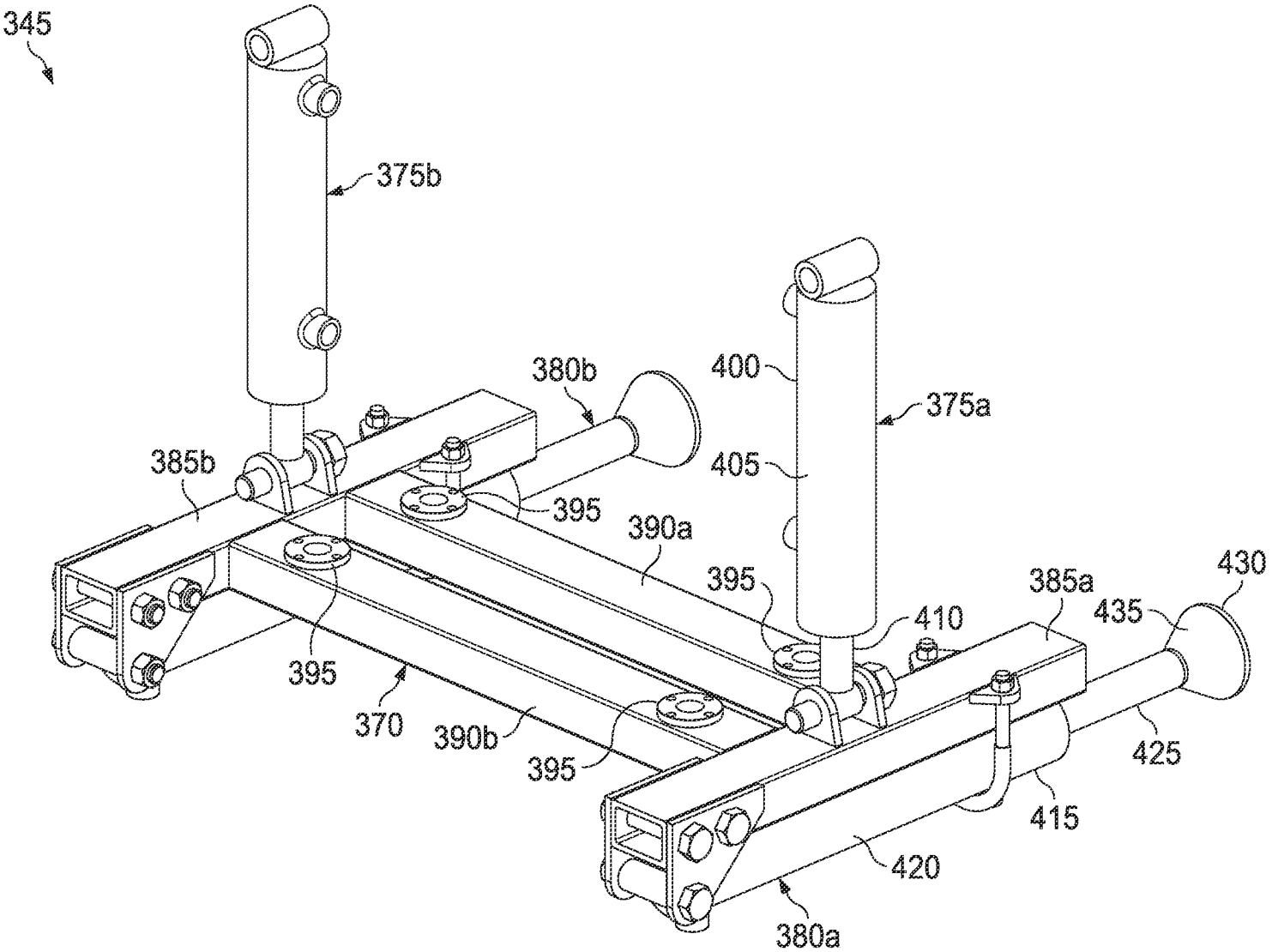
FIG. 6B is another perspective view of the grapple assembly of the swap station of FIGS. 5A through 5C, according to one or more embodiments.
Figure 6C:
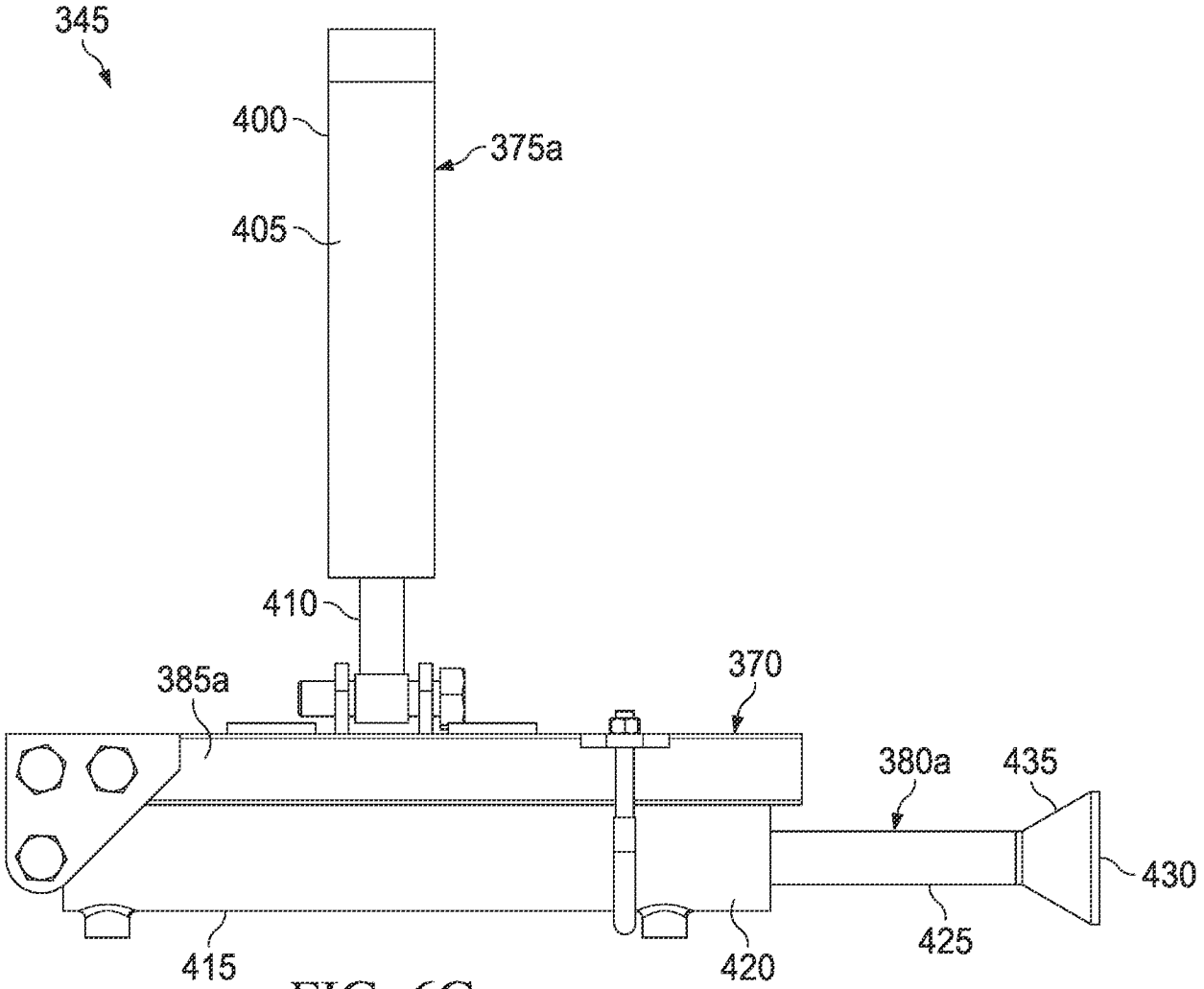
FIG. 6C is an elevational view of the grapple assembly of the swap station of FIGS. 5A through 5C, according to one or more embodiments.

Referring to FIGS. 6A through 6C, with continuing reference to FIGS. 5A through 5C, in an embodiment, the grapple assembly 345 includes a support frame 370, a pair of linear (e.g., vertical) actuators 375*a-b*, and a pair of linear (e.g., horizontal) actuators 380*a-b*. The controller 220 is adapted to send control signals to, and receive feedback (e.g., position feedback) from, the linear actuators 375*a-b* and the linear actuators 380*a-b*. The support frame 370 includes a pair of support members 385*a-b* and a pair of support members 390*a-b*. In one or more embodiments, the support members 385*a-b* are spaced apart in a parallel relation. The support members 390*a-b* are each connected at one end to the support member 385*a* and at the other end to the support member 385*b*. In one or more embodiments, the support members 390*a-b* are spaced apart in a parallel relation. A plurality of guide holes 395 are formed through the support members 390*a-b*. The guide holes 395 each receive one of the guide rods 365 therethrough to guide the grapple assembly 345 within a range of motion (e.g., a vertical range of motion).

The linear actuator 375*a* is connected to, and extends perpendicularly from, the support member 385*a*. In one or more embodiments, the linear actuator 375*a* is or includes a hydraulic piston 400 having a cylinder 405 and a rod 410 extending from the cylinder 405 and movable relative thereto to actuate the linear actuator 375*a*. More particularly, the cylinder 405 of the linear actuator 375*a* is connected to the support frame 355 of the swap station 135*ba*, and the rod 410 of the linear actuator 375*a* is connected to the support member 385*a* of the grapple assembly 345. Although described as being or including the hydraulic piston 400 having the cylinder 405 and the rod 410, the linear actuator 375*a* may instead be or include another suitable type of linear actuator (e.g., another hydraulic actuator, a mechanical actuator, an electrical actuator, etc.). The linear actuator 380*a* is connected to, and extends in a parallel relation with, the support member 385*a*, opposite the linear actuator 375*a*. In one or more embodiments, the linear actuator 380*a* is or includes a hydraulic piston 415 including a cylinder 420 and a rod 425 extending from the cylinder 420 and movable relative thereto to actuate the linear actuator 380*a*. The linear actuator 380*a* also has a grapple 430 at a distal end of the rod 425, said grapple 430 including a tapered (e.g., frustoconical) surface 435. Although described as being or including the hydraulic piston 415 having the cylinder 420 and the rod 425, the linear actuator 380*a* may instead be or include another suitable type of linear actuator (e.g., another hydraulic actuator, a mechanical actuator, an electrical actuator, etc.) having the grapple 430 connected at a distal end thereof.

Similarly, the linear actuator 375*b* is connected to, and extends perpendicularly from, the support member 385*b*. The linear actuator 375*b* is substantially identical to the linear actuator 375*a*, and, therefore, will not be described in further detail. The linear actuator 380*b* is connected to, and extends in a parallel relation with, the support member 385*b*, opposite the linear actuator 375*b*. The linear actuator 380*b* is substantially identical to the linear actuator 380*a*, and, therefore, will not be described in further detail.

Figure 7A:
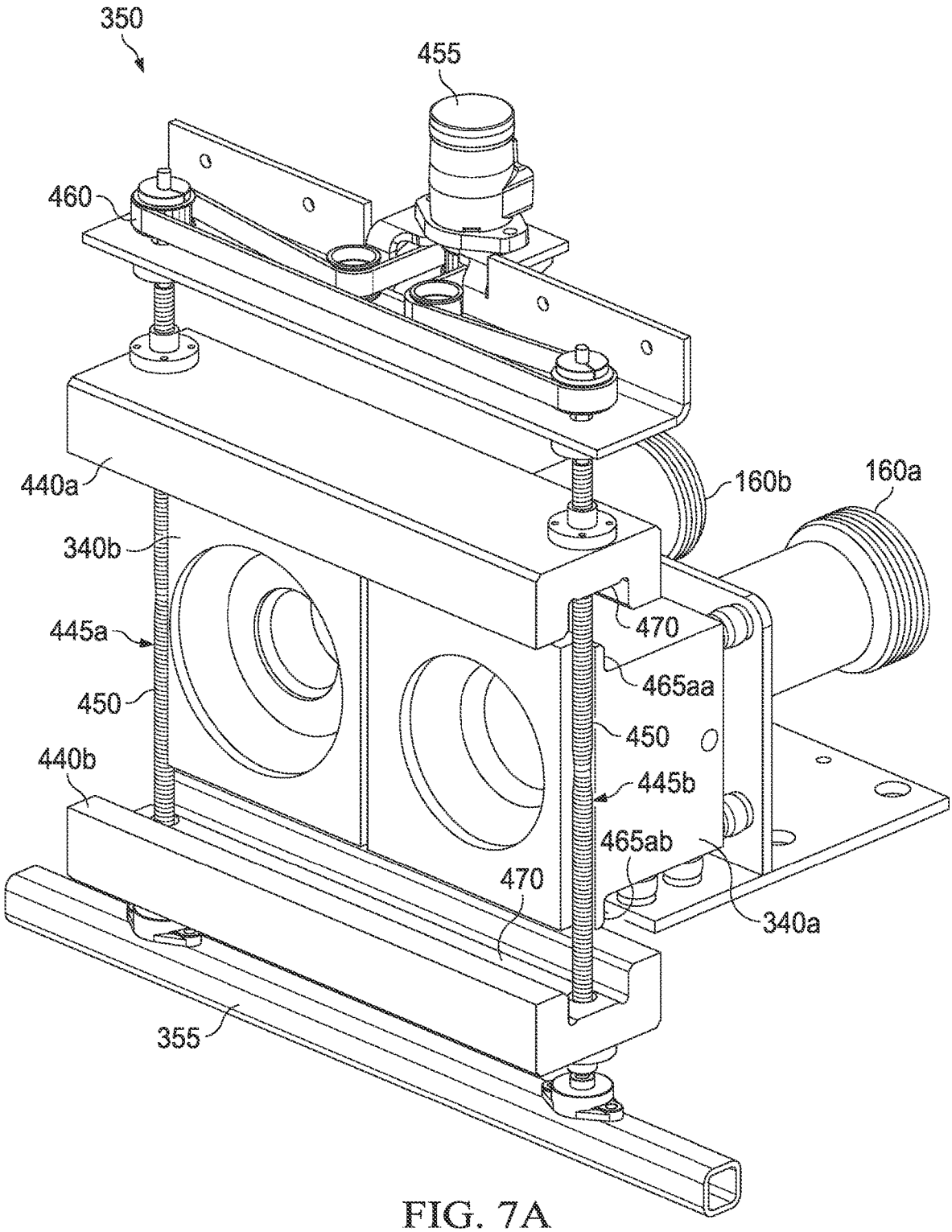
FIG. 7A is a perspective view of a lock assembly of the swap station of FIGS. 5A through 5C, according to one or more embodiments.
Figure 7B:
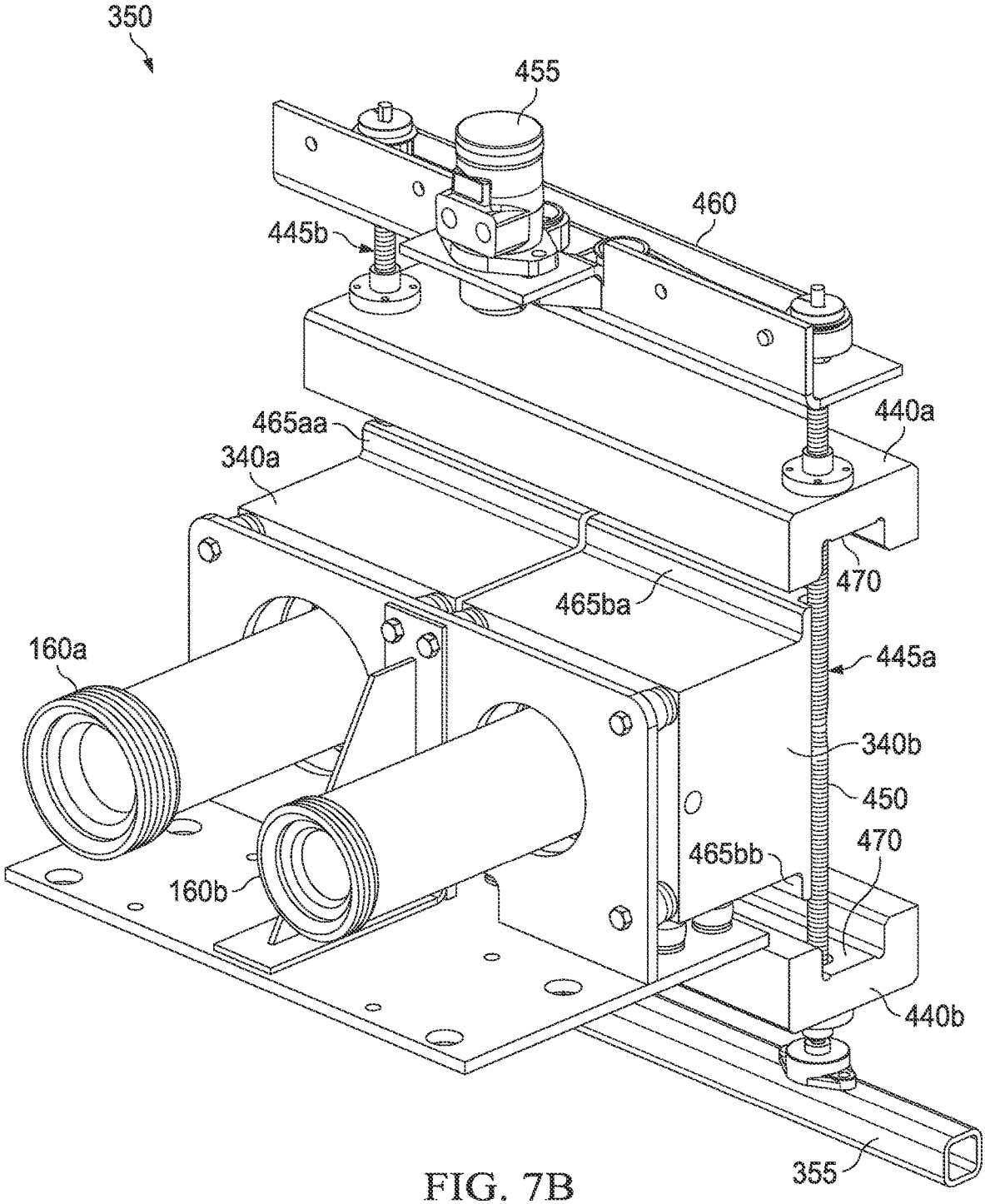
FIG. 7B is another perspective view of the lock assembly of the swap station of FIGS. 5A through 5C, according to one or more embodiments.
Figure 7C:
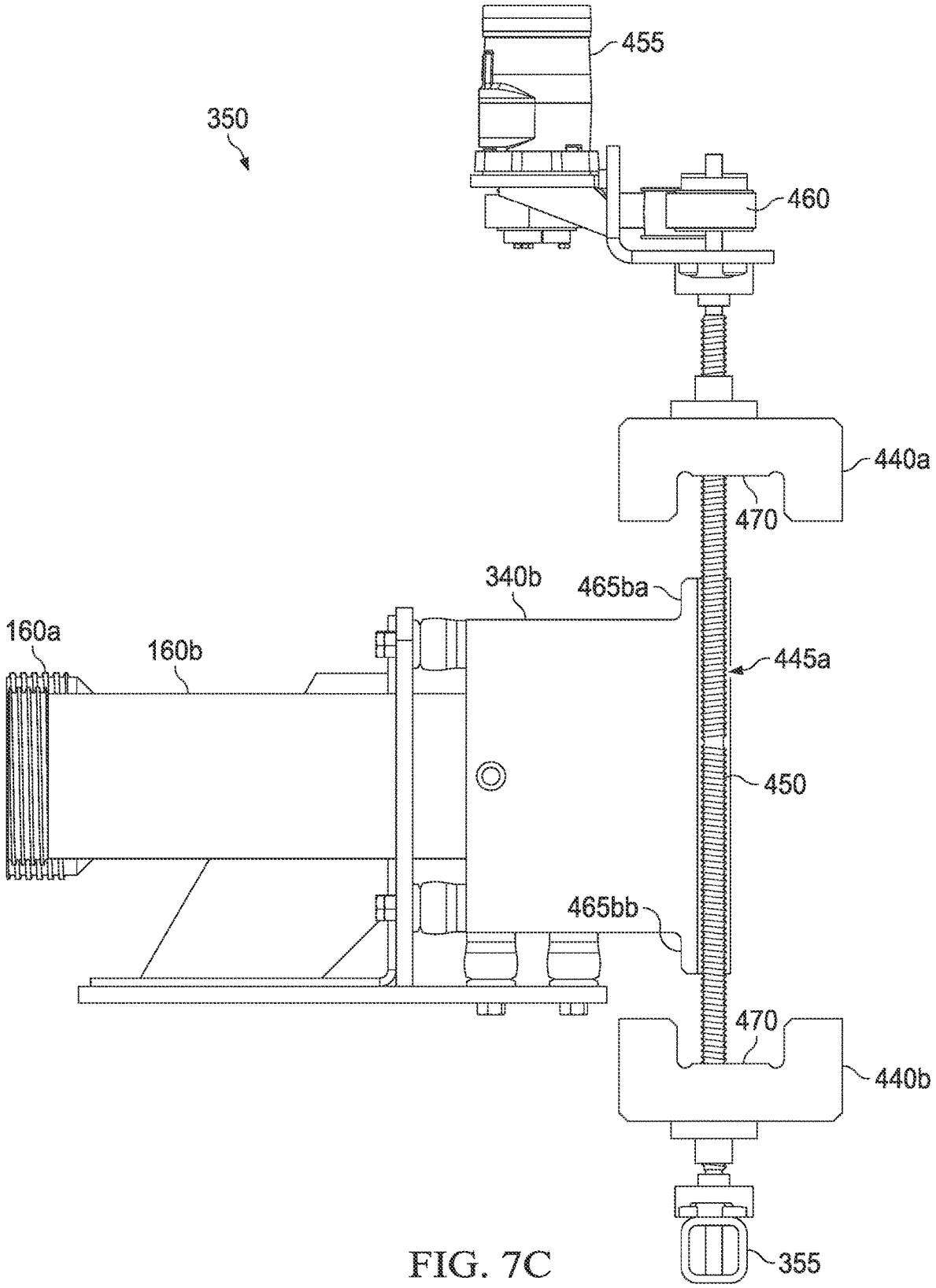
FIG. 7C is an elevational view of the lock assembly of the swap station of FIGS. 5A through 5C, according to one or more embodiments.

Referring to FIGS. 7A through 7C, with continuing reference to FIGS. 5A through 5C, the lock assembly 350 includes a pair of clamps 440*a-b* and a pair of linear (e.g., vertical) actuators 445*a-b*. In one or more embodiments, the linear actuators 445*a-b* each are or includes a threaded rod 450 threadably engaging the clamps 440*a-b*. As a result, when rotated in one angular direction, the threaded rods 450 move the clamps 440*a-b* closer together. Conversely, when rotated in the other angular direction, the threaded rods 450 moves the clamps 440*a-b* farther apart. The linear actuator 445*b* is substantially identical to the linear actuator, and, therefore, will not be described in further detail. In one or more embodiments, the lock assembly 350 also includes a motor 455 adapted to rotate the linear actuators 445*a-b* using a chain or belt 460. Although described as including the motor 455, the chain or belt 460, and the linear actuators 445*a-b*, each being or including the threaded rod 450 to move the clamps 440*a-b* closer together, and farther apart, one or both of the linear actuators 445*a-b* may be omitted in favor of another suitable type of linear actuator (e.g., a hydraulic actuator, and electrical actuator, a mechanical actuator, etc.).

The suction flow component 340*a* defines opposing clamping holds 465*aa-ab*, and the discharge flow component 340*b* defines opposing clamping holds 465*ba-bb*. The clamps 440*a-b* each define a channel 470 adapted to secure the suction fitting 270*a* and the discharge fitting 275*a* of the swap adapter 175 to the suction flow component 340*a* and the discharge flow component 340*b*, respectively, of the swap station 135*ba*. More particularly, when the clamps 440*a-b* are moved closer together: the channel 470 of the clamp 440*a* is adapted to receive the clamping hold 335*a* of the swap adapter 175, the clamping hold 465*aa* of the suction flow component 340*a*, and the clamping hold 465*ba* of the discharge flow component 340*b*; and the channel 470 of the clamp 440*b* is adapted to receive the clamping hold 335*b* of the swap adapter 175, the clamping hold 465*ab* of the suction flow component 340*a*, and the clamping hold 465*bb* of the discharge flow component 340*b*.

Figure 8:
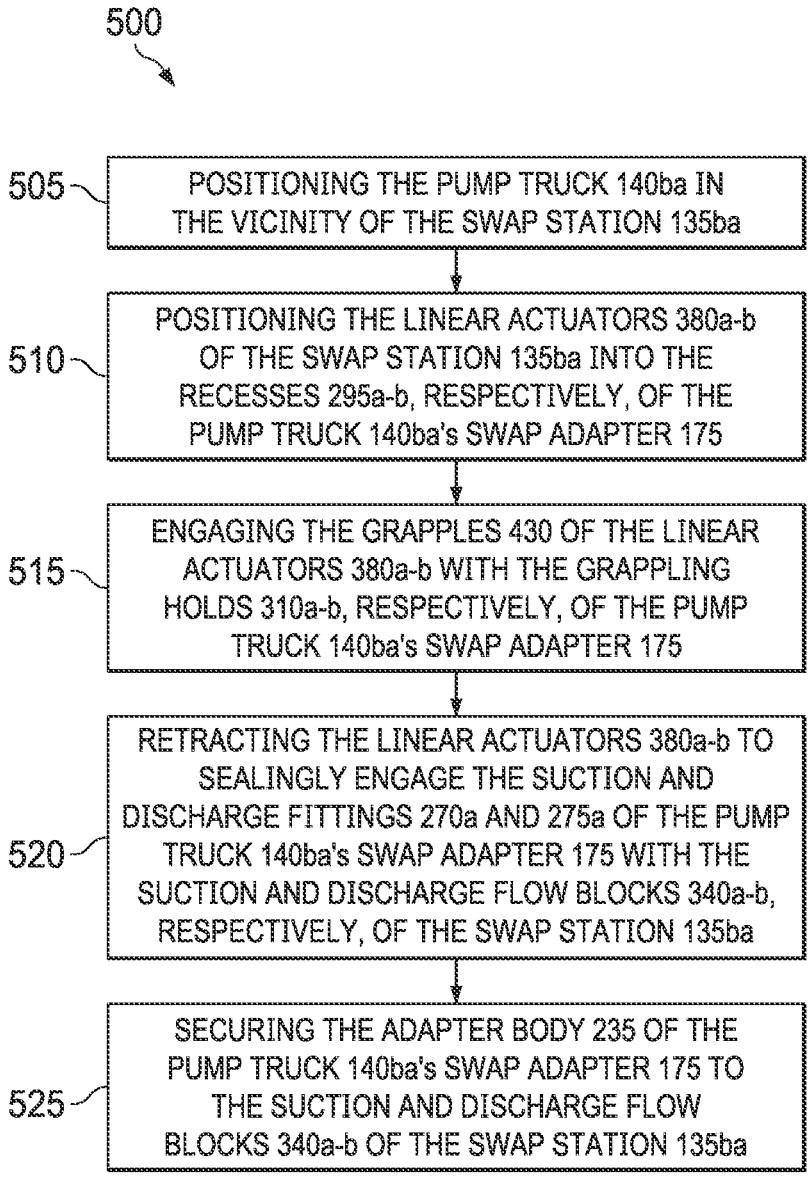
FIG. 8 is a flow diagram illustrating a method for using the swap station of FIGS. 2A and 2B, according to one or more embodiments.

Referring to FIGS. 8 and 9A through 9J, with continuing reference to FIGS. 1A through 7C, in an embodiment, a method for connecting the swap adapter 175 of the pump truck 140*ba* to the swap station 135*ba* is generally referred to by the reference numeral 500. As shown in FIG. 8, the method 500 includes: at a step 505, positioning the pump truck 140*ba* in the vicinity of the swap station 135*ba*; at a step 510, positioning the linear actuators 380*a-b* of the swap station 135*ba* into the recesses 295*a-b*, respectively, of the pump truck 140*ba*'s swap adapter 175; at a step 515, engaging the grapples 430 of the linear actuators 380*a-b* with the grappling holds 310*a-b*, respectively, of the pump truck 140*ba*'s swap adapter 175; at a step 520, retracting the linear actuators 380*a-b* to sealingly engage the suction and discharge fittings 270*a* and 275*a* (shown in FIGS. 4A and 4B) of the pump truck 140*ba*'s swap adapter 175 with the suction and discharge flow components 340*a-b*, respectively, of the swap station 135*ba*; and at a step 525, securing the adapter body 235 of the pump truck 140*ba*'s swap adapter 175 to the suction and discharge flow components 340*a-b* of the swap station 135*ba*.

Figure 9A:
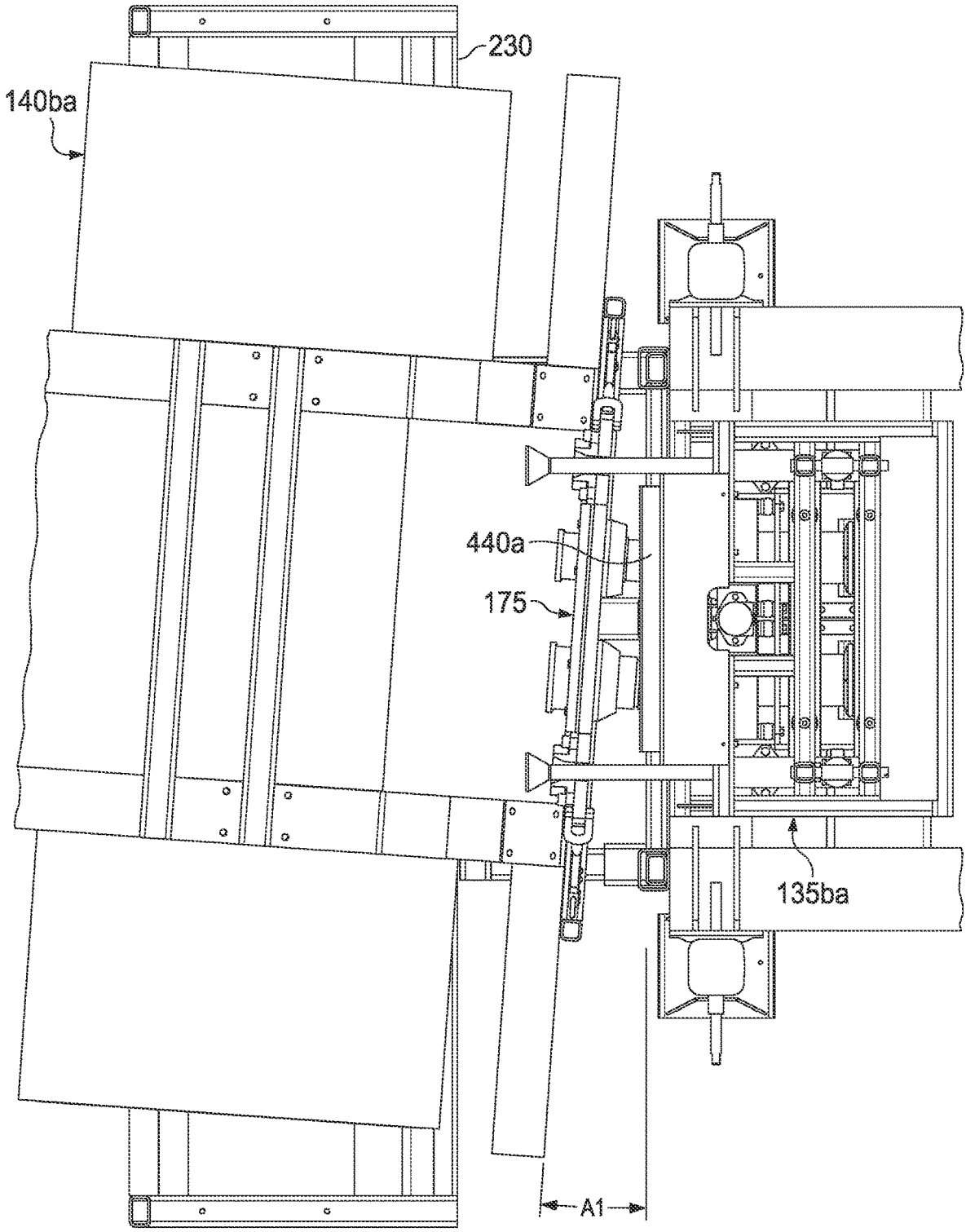
FIG. 9A is top plan view illustrating execution of a first step of the method illustrated in FIG. 8, according to one or more embodiments.
Figure 9B:
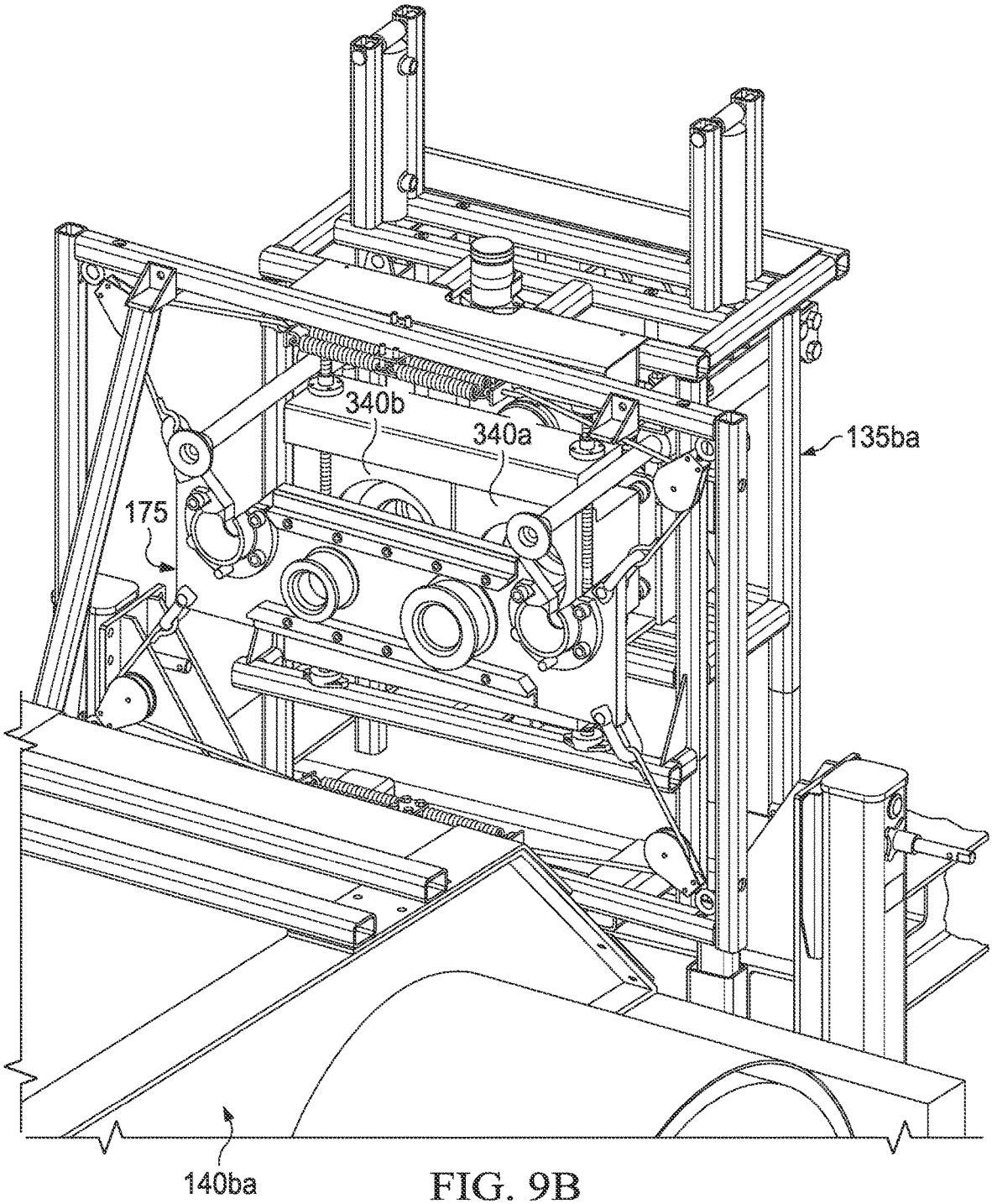
FIG. 9B is a perspective view illustrating execution of the first step of the method illustrated in FIG. 8, according to one or more embodiments.
Figure 9C:
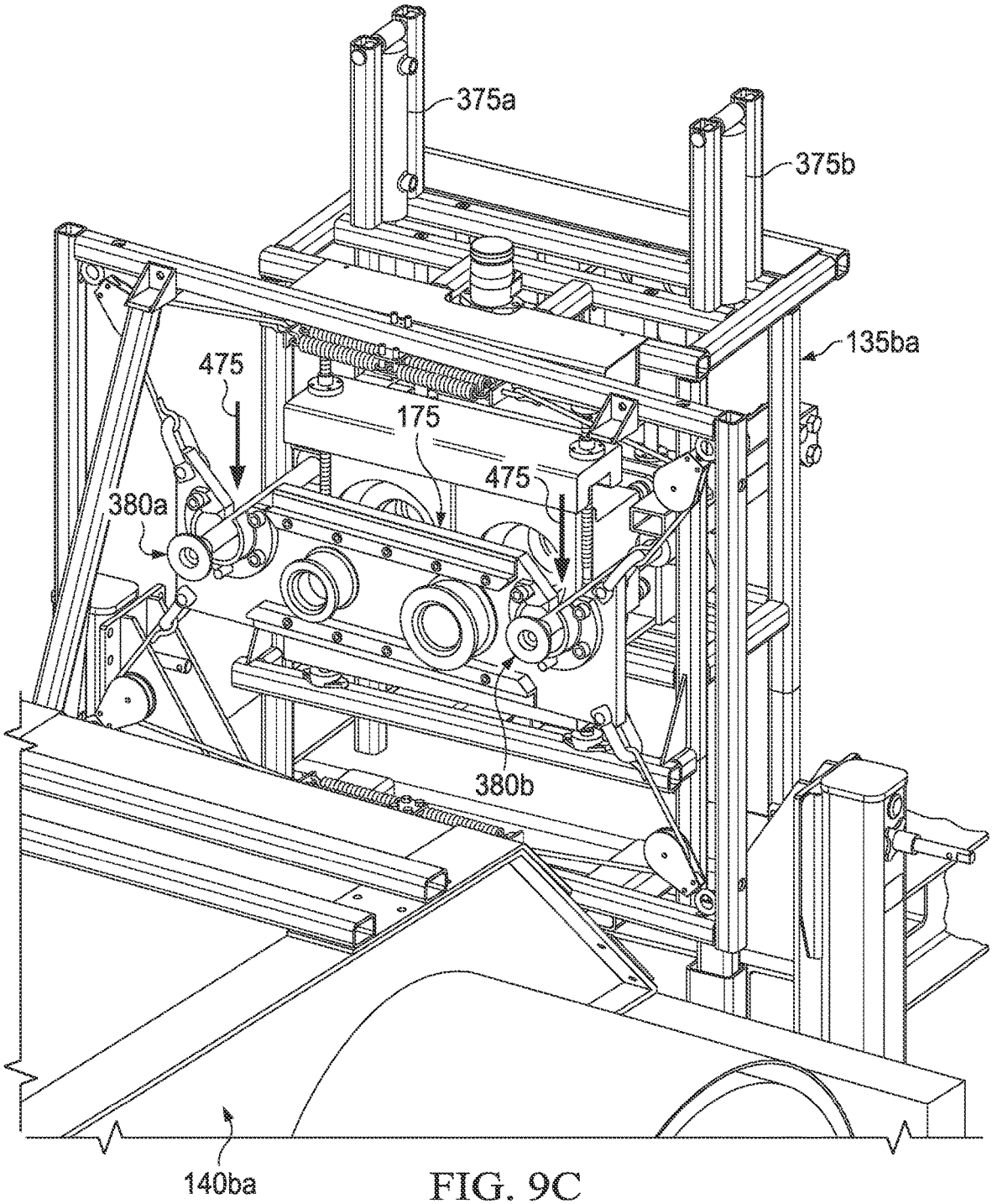
FIG. 9C is a perspective view illustrating execution of a second step of the method illustrated in FIG. 8, according to one or more embodiments.

The suction and discharge conduits 185*a-b* are omitted from view in FIGS. 9A through 9J for clarity. As shown in FIGS. 9A and 9B, at the step 505 of positioning the pump truck 140*ba* in the vicinity of the swap station 135*ba*, the pump truck 140*ba* is backed into engagement with the chock assembly 230. In one or more embodiments, as in FIG. 9A, when so positioned, the pump truck 140*ba*'s swap adapter 175 may extend at an angle A1 relative to the suction and discharge flow components 340*a-b* of the swap station 135*ba*. As shown in FIG. 9C, at the step 510 of positioning the linear actuators 380*a-b* of the swap station 135*ba* into the recesses 295*a-b* (shown in FIGS. 4A through 4C), respectively, of the pump truck 140*ba*'s swap adapter 175, the extended linear actuators 380*a-b* are lowered into the recesses 295*a-b*, respectively, of the pump truck 140*ba*'s swap adapter 175 by extending the linear actuators 375*a-b* (as indicated by arrows 475 in FIG. 9C). More particularly, the inclined surfaces 305*a-b* and 325*a-b* (shown in FIGS. 4A through 4C) guide the extended linear actuators 380*a-b* into the slots 300 (shown in FIGS. 4A through 4C) during the lowering of the extended linear actuators 380*a-b* into the recesses 295*a-b*, respectively, of the pump truck 140*ba*'s swap adapter 175. In this manner, the grapple assembly 345 is able to move the adapter body 235 in a first horizontal direction via engagement with the inclined surfaces 305*a-b* and 325*a-b* as the extended linear actuators 380*a-b* are lowered into the recesses 295*a-b*, respectively. Additionally, once the extended linear actuators 380*a-b* have "bottomed out" in the respective slots 300 of the recesses 295*a-b*, further lowering of the extended linear actuators 380*a-b* moves the adapter body 235 in a vertical (e.g., downward) direction.

Figure 9D:
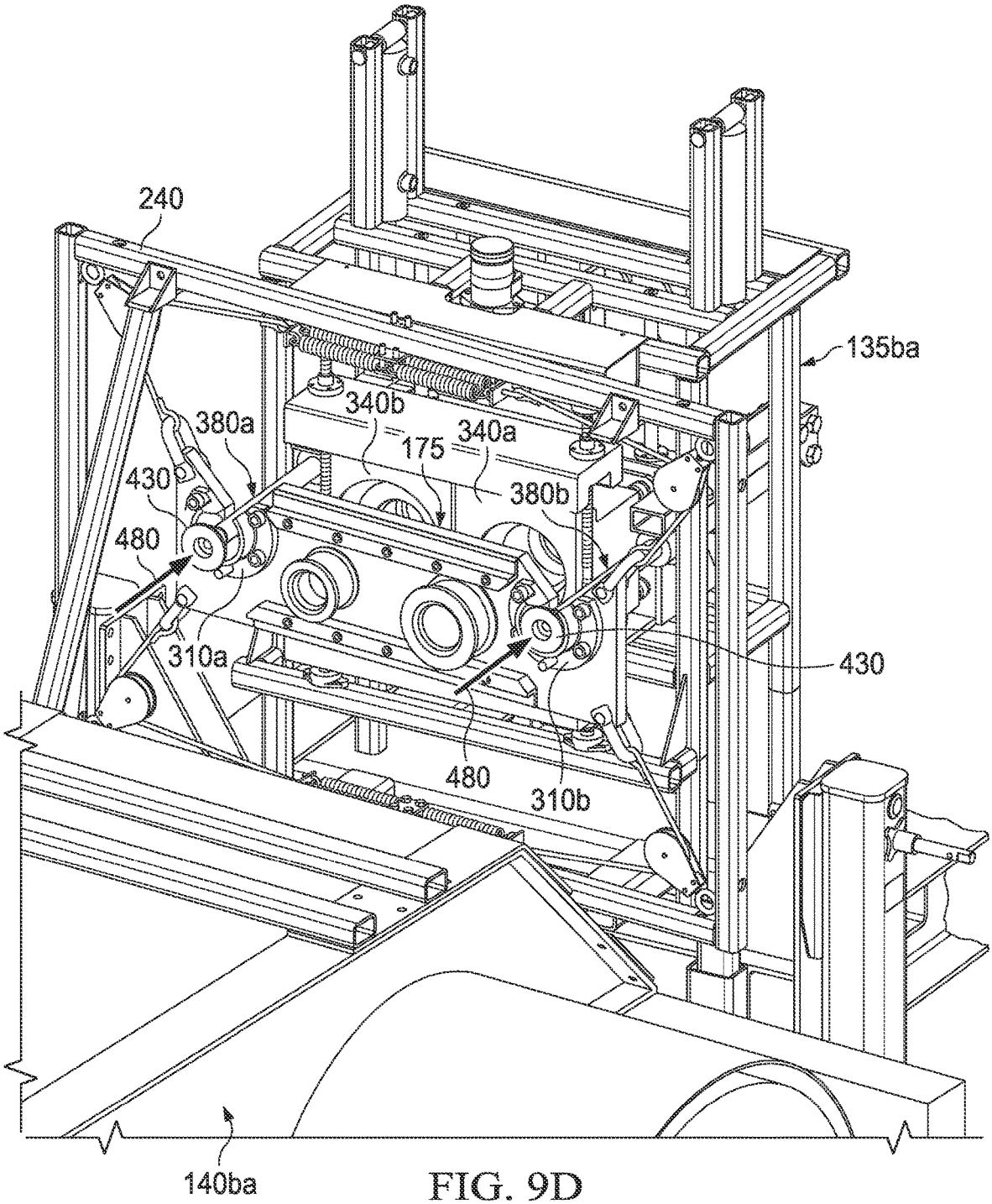
FIG. 9D is a perspective view illustrating execution of a third step of the method illustrated in FIG. 8, according to one or more embodiments.
Figure 9E:
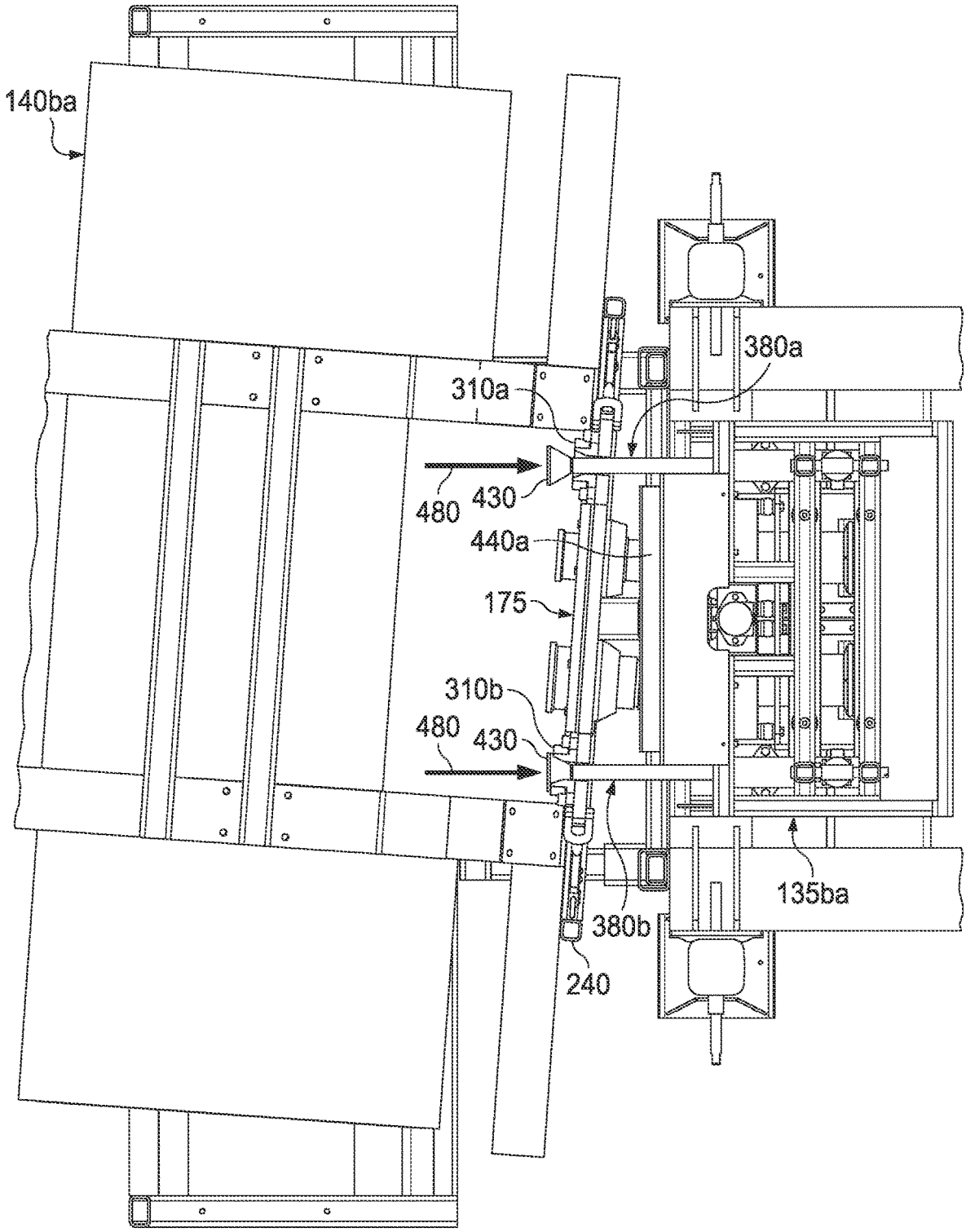
FIG. 9E is a top plan view illustrating execution of the third step of the method illustrated in FIG. 8, according to one or more embodiments.
Figure 9F:
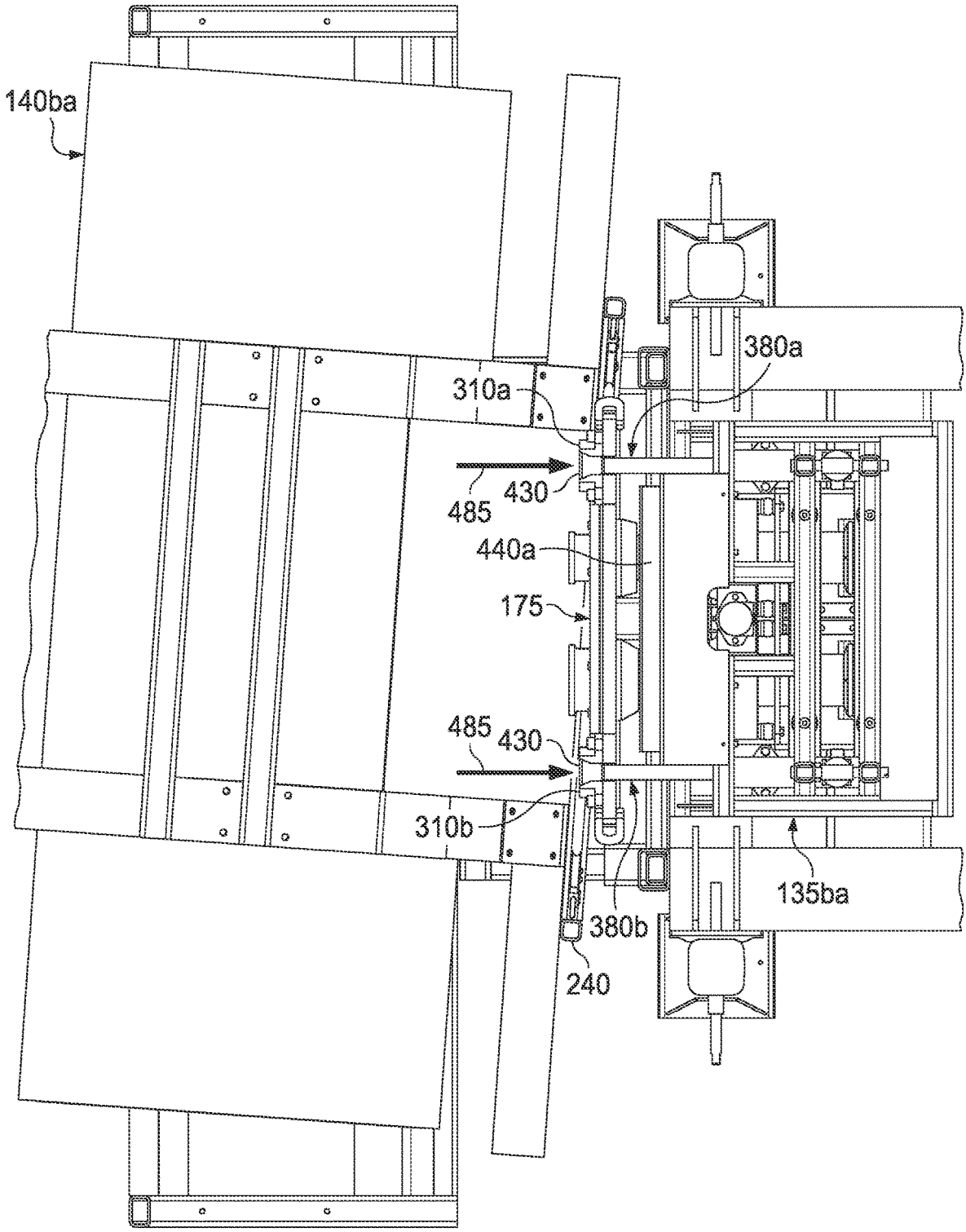
FIG. 9F is a top plan view illustrating execution of the third step of the method illustrated in FIG. 8, according to one or more embodiments.

As shown in FIGS. 9D through 9F, at the step 515 of engaging the grapples 430 of the linear actuators 380*a-b* with the grappling holds 310*a-b*, respectively, of the pump truck 140*ba*'s swap adapter 175, the tapered surfaces 435 (shown in FIGS. 6A through 6C) of the linear actuators 380*a-b*'s grapples 430 engage the tapered surfaces 330 (shown in FIG. 4C) of the grappling holds 310*a-b*, respectively, to straighten the swap adapter 175's adapter body 235 (shown in FIGS. 3 and 4A through 4C) relative to the suction and discharge flow components 340*a-b*, thereby compensating for any angular offset between the adapter body 235 and the suction and discharge flow components 340*a-b*, as defined by the angle A1 (as indicated by arrows 480 in FIGS. 9D and 9E, and arrows 485 in FIG. 9F). In this manner, the grapple assembly 345 is able to move the adapter body 235 in an angular direction via engagement with the grappling holds 310*a-b*.

Figure 9G:
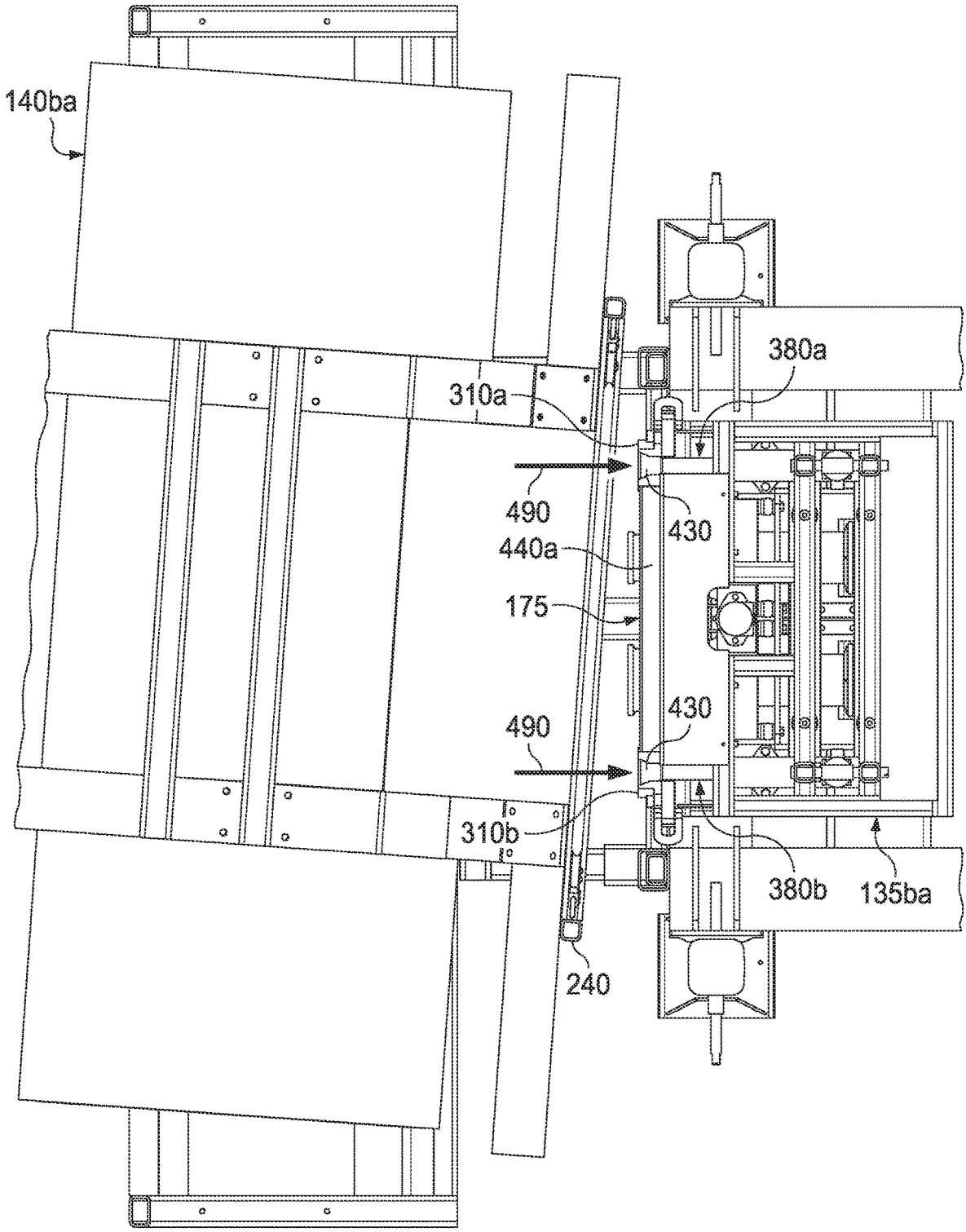
FIG. 9G is a top plan view illustrating execution of a fourth step of the method illustrated in FIG. 8, according to one or more embodiments.
Figure 9H:
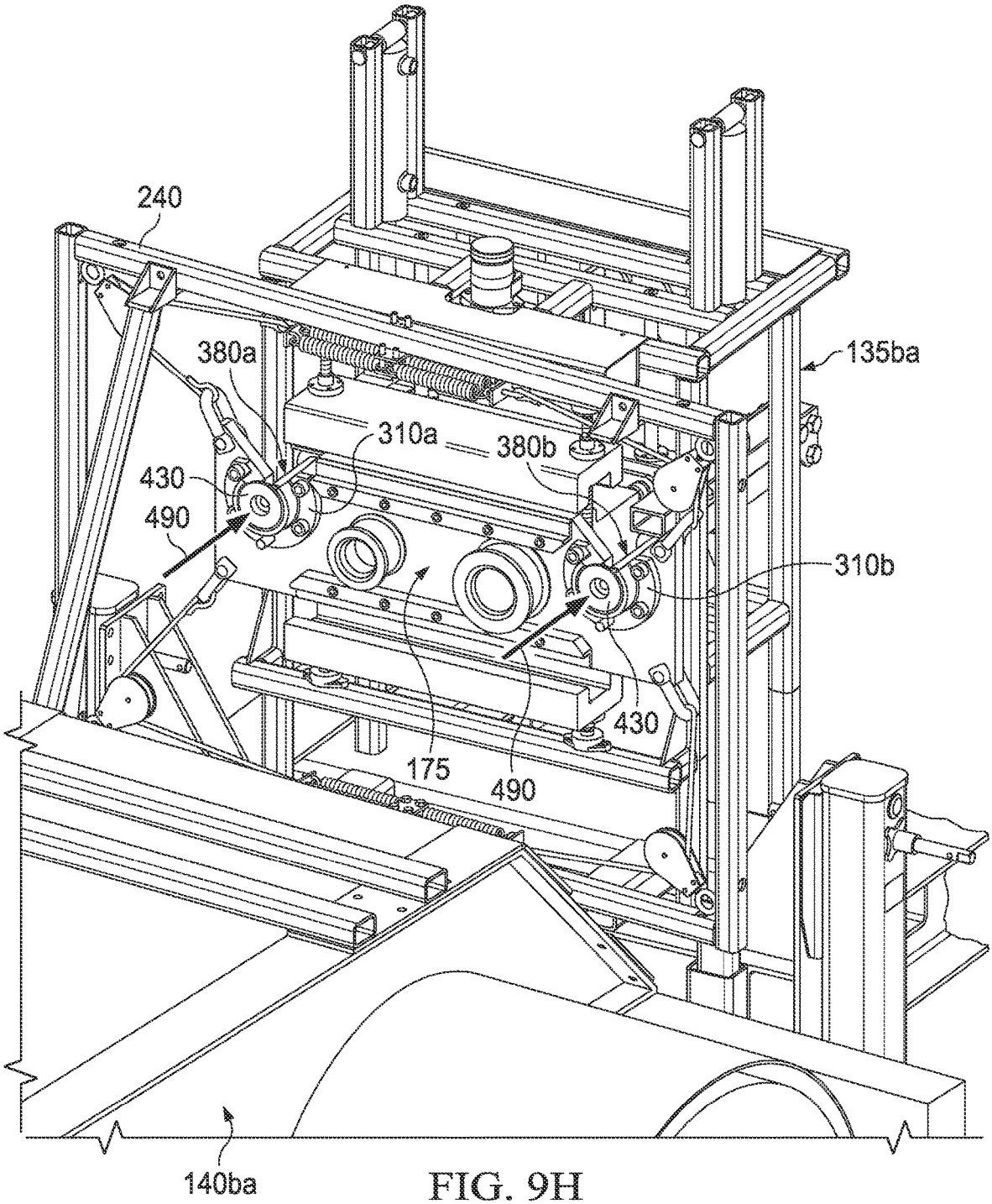
FIG. 9H is a perspective view illustrating execution of the fourth step of the method illustrated in FIG. 8, according to one or more embodiments.
Figure 9I:
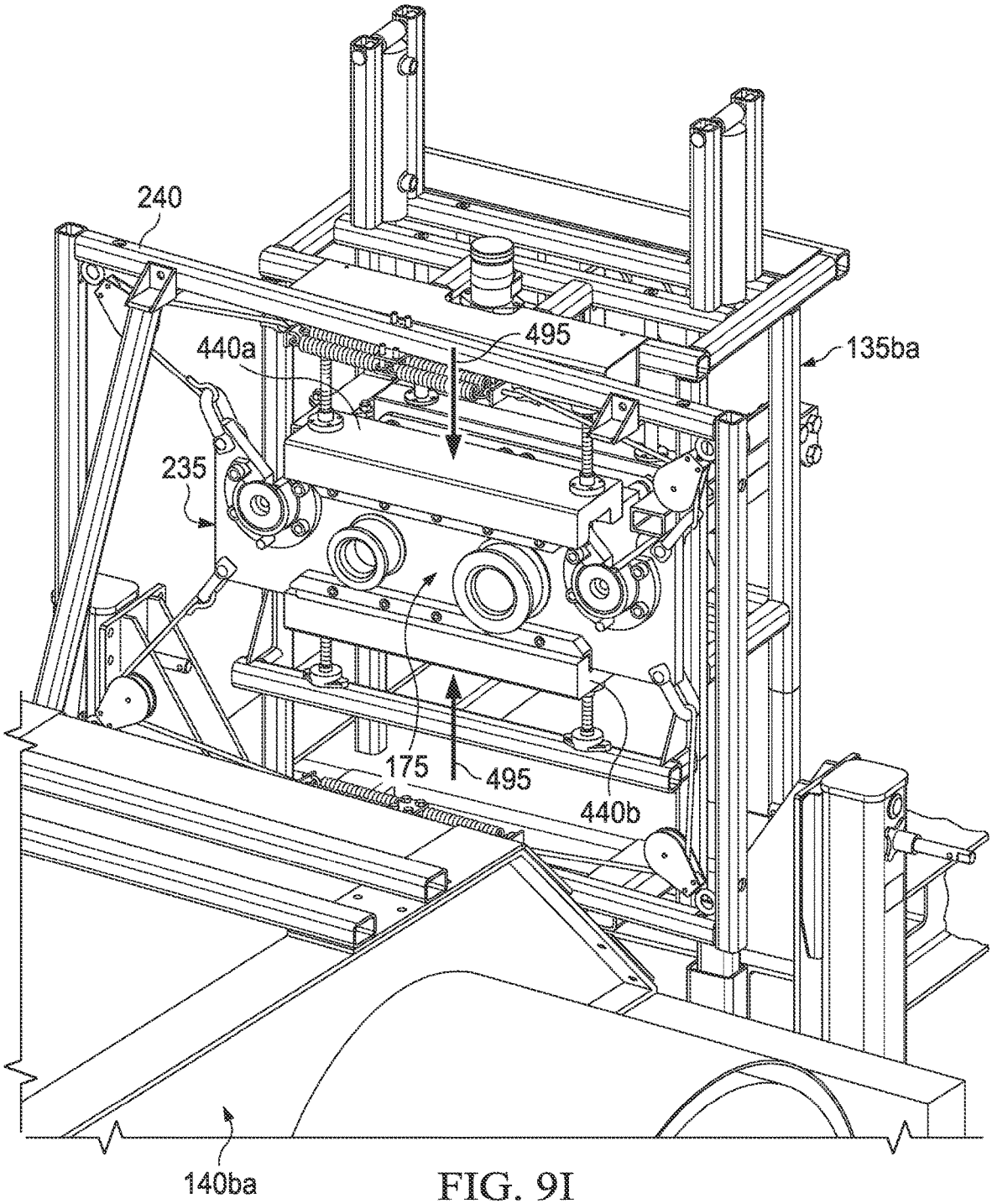
FIG. 9I is a perspective view illustrating execution of a fifth step of the method illustrated in FIG. 8, according to one or more embodiments.

During execution of the step 515, the suspension assembly 245 of the swap adapter 175 allows the adapter body 235 to "float" relative to the adapter frame 240, while the adapter frame 240 remains fixed to the pump truck 140*ba*. As shown in FIGS. 9G and 9H, at the step 520 of retracting the linear actuators 380*a-b* to sealingly engage the suction and discharge fittings 270*a* and 275*a* (shown in FIGS. 4A and 4B) of the pump truck 140*ba*'s swap adapter 175 with the suction and discharge flow components 340*a-b*, respectively, of the swap station 135*ba*, the tapered surfaces 435 (shown in FIGS. 6A through 6C) of the linear actuators 380*a-b*'s grapples 430 engage the tapered surfaces 330 (shown in FIG. 4C) of the grappling holds 310*a-b*, respectively, to urge the suction and discharge fittings 270*a* and 275*a* (shown in FIGS. 4A and 4B) of the pump truck 140*ba*'s swap adapter 175 into sealing engagement the suction and discharge flow components 340*a-b*, respectively, of the swap station 135*ba* (as indicated by arrows 490 in FIGS. 9G and 9H). In this manner, the grapple assembly 345 is able to move the adapter body 235 in a second horizontal direction via engagement with the grappling holds 310*a-b*. During execution of the step 520, the suspension assembly 245 of the swap adapter 175 allows the adapter body 235 to "float" relative to the adapter frame 240, while the adapter frame 240 remains fixed to the pump truck 140*ba*.

Figure 9J:
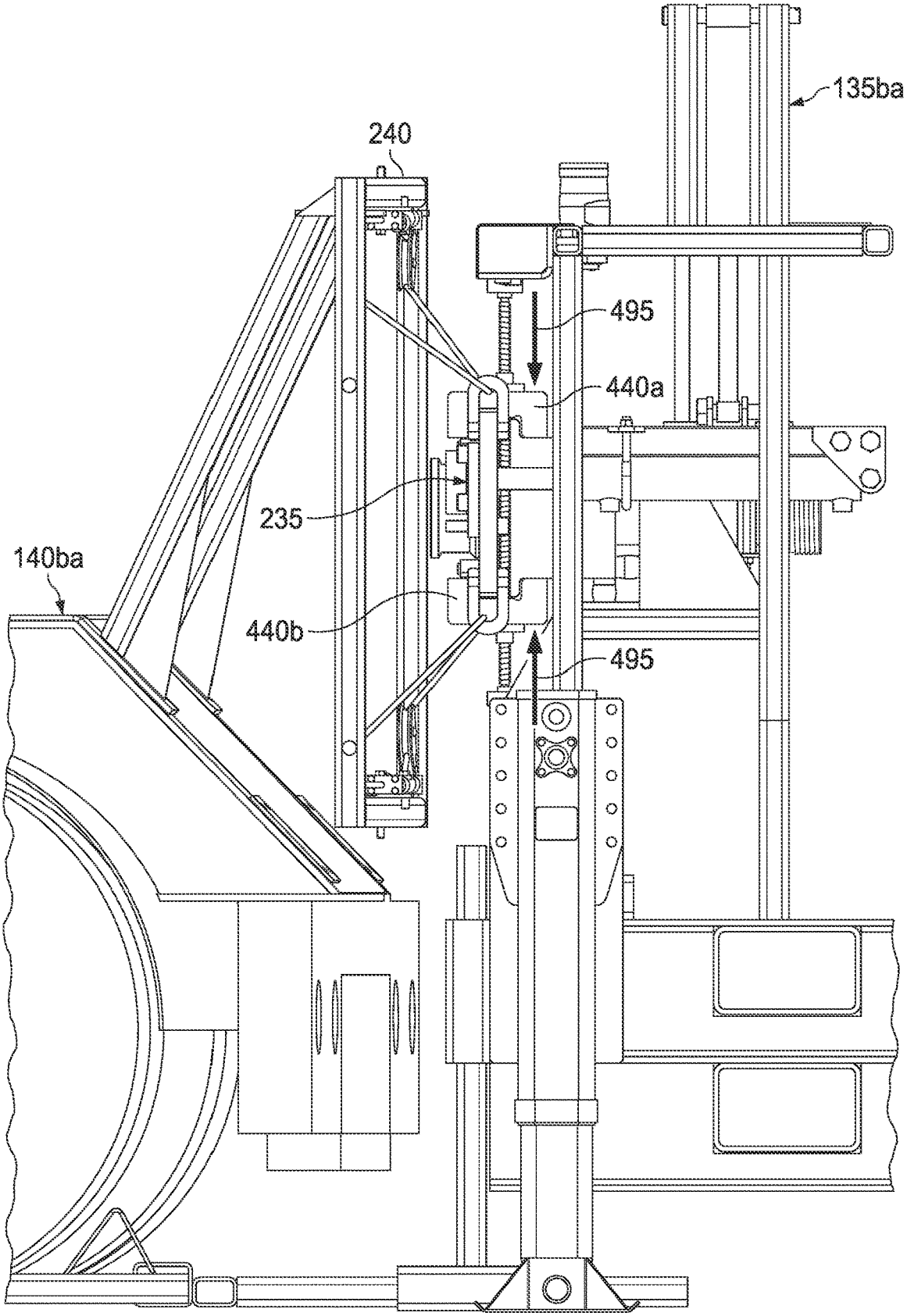
FIG. 9J is an elevational view illustrating execution of the fifth step of the method illustrated in FIG. 8, according to one or more embodiments.

Finally, as shown in FIGS. 91 and 9J, at the step 525 of securing the adapter body 235 of the pump truck 140*ba*'s swap adapter 175 to the suction and discharge flow components 340*a-b* of the swap station 135*ba*, the clamps 440*a-b* are moved closer together (as indicated by arrows 495 in FIGS. 9I and 9J) so that: the channel 470 (shown in FIGS. 7A through 7C) of the clamp 440*a* receives the clamping hold 335*a* (shown in FIGS. 4A and 4C) of the swap adapter 175, the clamping hold 465*aa* (shown in FIGS. 7A and 7B) of the suction flow component 340*a*, and the clamping hold 465*ba* (shown in FIGS. 7B and 7C) of the discharge flow component 340*b*; and the channel 470 (shown in FIGS. 7A through 7C) of the clamp 440*b* receives the clamping hold 335*b* (shown in FIG. 4C) of the swap adapter 175, the clamping hold 465*ab* (shown in FIG. 7A) of the suction flow component 340*a*, and the clamping hold 465*bb* (shown in FIG. 7C) of the discharge flow component 340*b*.

In one or more embodiments, the operation of the hydraulic fracturing system 100, the hot swappable fracturing pump system 155, or both, and/or the execution of the method 500 allow(s) for one or more hydraulic fracturing pumps (e.g., the hydraulic fracturing pump 175 of the pump truck 140*ba*) to be swapped out for a replacement hydraulic fracturing pump while one or more other hydraulic fracturing pumps (e.g., the hydraulic fracturing pump 175' of the pump truck 140*bb*) remain operational, drawing fluid from the suction manifold 125 and providing pressurized fluid to the discharge manifold 130.

Figure 10:
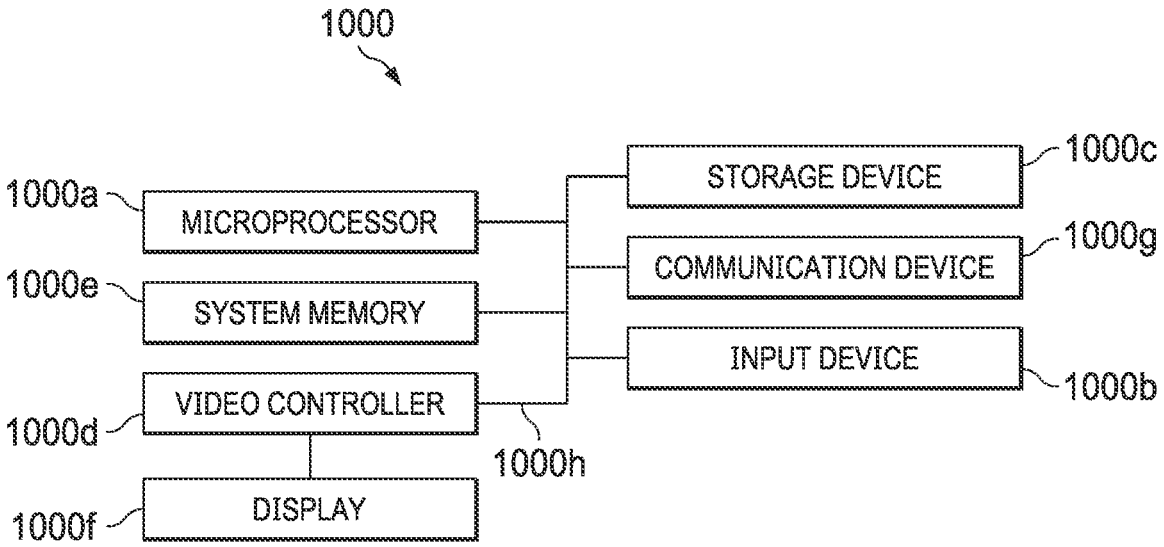
FIG. 10 is a diagrammatic illustration of a computing node for implementing one or more embodiments of the present disclosure.

Referring to FIG. 10, with continuing reference to FIGS. 1A through 9J, an illustrative node 1000 for implementing one or more of the embodiments of one or more of the controller(s) (e.g., the controller 220), element(s), apparatus, system(s) (e.g., the hydraulic fracturing system 100 and/or the hot swappable fracturing pump system 155), method(s) (e.g., the method 500), step(s), and/or sub-step(s), or any combination thereof, described above and/or illustrated in FIGS. 1A through 9J is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In one or more embodiments, the storage device 1000*c* may include a hard drive, CD-ROM, optical drive, any other form of storage device and/or any combination thereof. In one or more embodiments, the storage device 1000*c* may include, and/or be capable of receiving, a CD-ROM, DVD-ROM, or any other form of non-transitory computer-readable medium that may contain executable instructions. In one or more embodiments, the communication device 1000*g* may include a modem, network card, or any other device to enable the node 1000 to communicate with other node(s). In one or more embodiments, the node and the other node(s) represent a plurality of interconnected (whether by intranet or Internet) computer systems, including without limitation, personal computers, mainframes, PDAs, smartphones and cell phones.

In one or more embodiments, one or more of the embodiments described above and/or illustrated in FIGS. 1A through 9J include at least the node 1000 and/or components thereof, and/or one or more nodes that are substantially similar to the node 1000 and/or components thereof. In one or more embodiments, one or more of the above-described components of the node 1000 and/or the embodiments described above and/or illustrated in FIGS. 1A through 9J include respective pluralities of same components.

In one or more embodiments, one or more of the embodiments described above and/or illustrated in FIGS. 1A through 9J include a computer program that includes a plurality of instructions, data, and/or any combination thereof; an application written in, for example, Arena, HyperText Markup Language (HTML), Cascading Style Sheets (CSS), JavaScript, Extensible Markup Language (XML), asynchronous JavaScript and XML (Ajax), and/or any combination thereof; a web-based application written in, for example, Java or Adobe Flex, which in one or more embodiments pulls real-time information from one or more servers, automatically refreshing with latest information at a predetermined time increment; or any combination thereof.

In one or more embodiments, a computer system typically includes at least hardware capable of executing machine readable instructions, as well as the software for executing acts (typically machine-readable instructions) that produce a desired result. In one or more embodiments, a computer system may include hybrids of hardware and software, as well as computer sub-systems.

In one or more embodiments, hardware generally includes at least processor-capable platforms, such as client-machines (also known as personal computers or servers), and hand-held processing devices (such as smart phones, tablet computers, or personal computing devices (PCDs), for example). In one or more embodiments, hardware may include any physical device that is capable of storing machine-readable instructions, such as memory or other data storage devices. In one or more embodiments, other forms of hardware include hardware sub-systems, including transfer devices such as modems, modem cards, ports, and port cards, for example.

In one or more embodiments, software includes any machine code stored in any memory medium, such as RAM or ROM, and machine code stored on other devices (such as floppy disks, flash memory, or a CD-ROM, for example). In one or more embodiments, software may include source or object code. In one or more embodiments, software encompasses any set of instructions capable of being executed on a node such as, for example, on a client machine or server.

In one or more embodiments, combinations of software and hardware could also be used for providing enhanced functionality and performance for certain embodiments of the present disclosure. In an embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In one or more embodiments, computer readable mediums include, for example, passive data storage, such as a random-access memory (RAM) as well as semi-permanent data storage such as a compact disk read only memory (CD-ROM). One or more embodiments of the present disclosure may be embodied in the RAM of a computer to transform a standard computer into a new specific computing machine. In one or more embodiments, data structures are defined organizations of data that may enable an embodiment of the present disclosure. In an embodiment, a data structure may provide an organization of data, or an organization of executable code.

In one or more embodiments, any networks and/or one or more portions thereof may be designed to work on any specific architecture. In an embodiment, one or more portions of any networks may be executed on a single computer, local area networks, client-server networks, wide area networks, internets, hand-held and other portable and wireless devices and networks.

In one or more embodiments, a database may be any standard or proprietary database software. In one or more embodiments, the database may have fields, records, data, and other database elements that may be associated through database specific software. In one or more embodiments, data may be mapped. In one or more embodiments, mapping is the process of associating one data entry with another data entry. In an embodiment, the data contained in the location of a character file can be mapped to a field in a second table. In one or more embodiments, the physical location of the database is not limiting, and the database may be distributed. In an embodiment, the database may exist remotely from the server, and run on a separate platform. In an embodiment, the database may be accessible across the Internet. In one or more embodiments, more than one database may be implemented.

In one or more embodiments, a plurality of instructions stored on a non-transitory computer readable medium may be executed by one or more processors to cause the one or more processors to carry out or implement in whole or in part one or more of the embodiments of one or more of the controller(s) (e.g., the controller 220), element(s), apparatus, system(s) (e.g., the hydraulic fracturing system 100 and/or the hot swappable fracturing pump system 155), method(s) (e.g., the method 500), step(s), and/or sub-step(s), or any combination thereof, described above and/or illustrated in FIGS. 1A through 9J. In one or more embodiments, such a processor may include one or more of the microprocessor 1000*a*, any processor(s) that are part of the components of the hydraulic fracturing system 100 and/or the hot swappable fracturing pump system 155, such as, for example, the controller 220, and/or any combination thereof, and such a computer readable medium may be distributed among one or more components of the system. In one or more embodiments, such a processor may execute the plurality of instructions in connection with a virtual computer system. In one or more embodiments, such a plurality of instructions may communicate directly with the one or more processors, and/or ay interact with one or more operating systems, middleware, firmware, other applications, and/or any combination thereof, to cause the one or more processors to execute the instructions.

A system has been disclosed according to one or more embodiments of the present disclosure. The system generally includes: a discharge manifold adapted to be pressurized by at least a first fracturing pump; a first swap adapter connected to a second fracturing pump via a first suction conduit and a first discharge conduit; and a swap station connected, via a second suction conduit, to a suction manifold, and, via a second discharge conduit, to the discharge manifold; wherein the first swap adapter is adapted to be connected to the swap station while the discharge manifold is pressurized by at least the first fracturing pump; and wherein, after the first swap adapter is connected to the swap station, and while the discharge manifold remains pressurized by at least the first fracturing pump, the second fracturing pump is adapted to: draw fluid from the suction manifold via the second suction conduit, the swap station, the first swap adapter, and the first suction conduit; and discharge pressurized fluid to the discharge manifold via the first discharge conduit, the first swap adapter, the swap station, and the second discharge conduit. In one or more embodiments, before connecting the first swap adapter to the swap station, and while the discharge manifold remains pressurized by at least the first fracturing pump, a second swap adapter is adapted to be disconnected from the swap station; and the second swap adapter is connected to a third fracturing pump via a third suction conduit and a third discharge conduit. In one or more embodiments, the swap station includes a grapple assembly adapted to connect the first swap adapter to the swap station by moving the first swap adapter into sealing engagement with the swap station. In one or more embodiments, the grapple assembly is adapted to move the first swap adapter into sealing engagement with the swap station by moving the first swap adapter in a vertical direction. In one or more embodiments, the grapple assembly is adapted to move the first swap adapter into sealing engagement with the swap station by moving the first swap adapter in a first horizontal direction, a second horizontal direction, or both. In one or more embodiments, the grapple assembly is adapted to move the first swap adapter into sealing engagement with the swap station by moving the first swap adapter in an angular direction. In one or more embodiments, the swap station further includes a lock assembly adapted to secure the first swap adapter in sealing engagement with the swap station. In one or more embodiments, the first swap adapter is connected to, and extends from, a pump truck; and the second fracturing pump is supported on the pump truck.

A method has also been disclosed according to one or more embodiments of the present disclosure. The method generally includes: connecting a first swap adapter to a swap station while a discharge manifold is pressurized by at least a first fracturing pump, wherein the first swap adapter is connected to a second fracturing pump via a first suction conduit and a first discharge conduit, wherein the swap station is connected to a suction manifold via a second suction conduit, and wherein the swap station is connected to the discharge manifold via a second discharge conduit; and after connecting the first swap adapter to the swap station, and while the discharge manifold remains pressurized by at least the first fracturing pump: drawing fluid from the suction manifold, using the second fracturing pump, via the second suction conduit, the swap station, the first swap adapter, and the first suction conduit; and discharging pressurized fluid into the discharge manifold, using the second fracturing pump, via the first discharge conduit, the first swap adapter, the swap station, and the second discharge conduit. In one or more embodiments, the method further includes: before connecting the first swap adapter to the swap station, and while the discharge manifold remains pressurized by at least the first fracturing pump, disconnecting a second swap adapter from the swap station, wherein the second swap adapter is connected to a third fracturing pump via a third suction conduit and a third discharge conduit. In one or more embodiments, connecting the first swap adapter to the swap station includes moving the first swap adapter into sealing engagement with the swap station while the first swap adapter remains connected to the second fracturing pump via the first suction conduit and the first discharge conduit. In one or more embodiments, moving the first swap adapter into sealing engagement with the swap station includes moving the first swap adapter in a vertical direction. In one or more embodiments, moving the first swap adapter into sealing engagement with the swap station includes moving the first swap adapter in a first horizontal direction, a second horizontal direction, or both. In one or more embodiments, moving the first swap adapter into sealing engagement with the swap station includes moving the first swap adapter in an angular direction. In one or more embodiments, connecting the first swap adapter to the swap station further includes securing the first swap adapter in sealing engagement with the swap station. In one or more embodiments, the first swap adapter is connected to, and extends from, a pump truck; and the second fracturing pump is supported on the pump truck.

A system has also been disclosed according to one or more embodiments of the present disclosure. The system generally includes: means for connecting a first swap adapter to a swap station while a discharge manifold is pressurized by at least a first fracturing pump, wherein the first swap adapter is connected to a second fracturing pump via a first suction conduit and a first discharge conduit, wherein the swap station is connected to a suction manifold via a second suction conduit, and wherein the swap station is connected to the discharge manifold via a second discharge conduit; and means for, after connecting the first swap adapter to the swap station, and while the discharge manifold remains pressurized by at least the first fracturing pump: drawing fluid from the suction manifold, using the second fracturing pump, via the second suction conduit, the swap station, the first swap adapter, and the first suction conduit; and discharging pressurized fluid into the discharge manifold, using the second fracturing pump, via the first discharge conduit, the first swap adapter, the swap station, and the second discharge conduit. In one or more embodiments, the system includes means for, before connecting the first swap adapter to the swap station, and while the discharge manifold remains pressurized by at least the first fracturing pump, disconnecting a second swap adapter from the swap station, wherein the second swap adapter is connected to a third fracturing pump via a third suction conduit and a third discharge conduit. In one or more embodiments, means for connecting the first swap adapter to the swap station includes means for moving the first swap adapter into sealing engagement with the swap station while the first swap adapter remains connected to the second fracturing pump via the first suction conduit and the first discharge conduit. In one or more embodiments, means for moving the first swap adapter into sealing engagement with the swap station includes means for moving the first swap adapter in a vertical direction. In one or more embodiments, means for moving the first swap adapter into sealing engagement with the swap station includes means for moving the first swap adapter in a first horizontal direction, a second horizontal direction, or both. In one or more embodiments, means for moving the first swap adapter into sealing engagement with the swap station includes means for moving the first swap adapter in an angular direction. In one or more embodiments, means for moving the first swap adapter into sealing engagement with the swap station includes means for moving the first swap adapter in one or more of the following: a vertical direction; a first horizontal direction; a second horizontal direction; an angular direction. In one or more embodiments, means for connecting the first swap adapter to the swap station further includes means for securing the first swap adapter in sealing engagement with the swap station. In one or more embodiments the first swap adapter is connected to, and extends from, a pump truck; and the second fracturing pump is supported on the pump truck.

An apparatus has also been disclosed according to one or more embodiments of the present disclosure. The apparatus generally includes: a non-transitory computer readable medium; and a plurality of instructions stored on the non-transitory computer readable medium and executable by one or more processors, wherein, when the instructions are executed by the one or more processors, the following steps are executed: connecting a first swap adapter to a swap station while a discharge manifold is pressurized by at least a first fracturing pump, wherein the first swap adapter is connected to a second fracturing pump via a first suction conduit and a first discharge conduit, wherein the swap station is connected to a suction manifold via a second suction conduit, and wherein the swap station is connected to the discharge manifold via a second discharge conduit; and after connecting the first swap adapter to the swap station, and while the discharge manifold remains pressurized by at least the first fracturing pump: drawing fluid from the suction manifold, using the second fracturing pump, via the second suction conduit, the swap station, the first swap adapter, and the first suction conduit; and discharging pressurized fluid into the discharge manifold, using the second fracturing pump, via the first discharge conduit, the first swap adapter, the swap station, and the second discharge conduit. In one or more embodiments, when the instructions are executed by the one or more processors, the following step is also executed: before connecting the first swap adapter to the swap station, and while the discharge manifold remains pressurized by at least the first fracturing pump, disconnecting a second swap adapter from the swap station, wherein the second swap adapter is connected to a third fracturing pump via a third suction conduit and a third discharge conduit. In one or more embodiments, connecting the first swap adapter to the swap station includes moving the first swap adapter into sealing engagement with the swap station while the first swap adapter remains connected to the second fracturing pump via the first suction conduit and the first discharge conduit. In one or more embodiments, moving the first swap adapter into sealing engagement with the swap station includes moving the first swap adapter in a vertical direction. In one or more embodiments, moving the first swap adapter into sealing engagement with the swap station includes moving the first swap adapter in a first horizontal direction, a second horizontal direction, or both. In one or more embodiments, moving the first swap adapter into sealing engagement with the swap station includes moving the first swap adapter in an angular direction. In one or more embodiments, connecting the first swap adapter to the swap station further includes: securing the first swap adapter in sealing engagement with the swap station. In one or more embodiments, the first swap adapter is connected to, and extends from, a pump truck; and the second fracturing pump is supported on the pump truck.

A swap station has also been disclosed according to one or more embodiments of the present disclosure. The swap station generally includes: suction and discharge flow components, wherein the suction flow component is adapted to be connected, via a first suction conduit, to a suction manifold, and wherein the discharge flow component is adapted to be connected, via a first discharge conduit, to a discharge manifold, said discharge manifold being adapted to be pressurized by at least a first fracturing pump; and a grapple assembly adapted to connect a swap adapter to the suction and discharge flow components while the discharge manifold is pressurized by at least the first fracturing pump by moving the swap adapter into sealing engagement with the suction and discharge flow components, wherein the swap adapter is connected to a second fracturing pump via a second suction conduit and a second discharge conduit. In one or more embodiments, after the swap adapter is connected to the suction and discharge flow components, and while the discharge manifold remains pressurized by at least the first fracturing pump, the second fracturing pump is adapted to: draw fluid from the suction manifold via the second suction conduit, the swap station, the swap adapter, and the first suction conduit; and discharge pressurized fluid to the discharge manifold via the first discharge conduit, the swap adapter, the swap station, and the second discharge conduit. In one or more embodiments, the swap station further includes a lock assembly adapted to secure the swap adapter in sealing engagement with the swap station. In one or more embodiments, the grapple assembly is adapted to move the swap adapter into sealing engagement with the swap station by moving the swap adapter in one or more of the following: a vertical direction; a first horizontal direction; a second horizontal direction; an angular direction. In one or more embodiments, swap station further includes: the suction manifold; the first suction conduit via which the suction flow component is adapted to be connected to the suction manifold; the discharge manifold; and the first discharge conduit via which the discharge flow component is adapted to be connected to the discharge manifold. In one or more embodiments, the swap station further includes the swap adapter; the second fracturing pump; the second suction conduit via which the swap adapter is connected to the second fracturing pump; and the second discharge conduit via which the swap adapter is connected to the second fracturing pump.

It is understood that variations may be made in the foregoing without departing from the scope of the present disclosure.

In several embodiments, the elements and teachings of the various embodiments may be combined in whole or in part in some (or all) of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down,"

etc., are for the purpose of illustration only and do not limit the specific orientation or location of the structure described above.

In several embodiments, while different steps, processes, and procedures are described as appearing as distinct acts, one or more of the steps, one or more of the processes, and/or one or more of the procedures may also be performed in different orders, simultaneously and/or sequentially. In several embodiments, the steps, processes, and/or procedures may be merged into one or more steps, processes and/or procedures.

In several embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A system, comprising:

a first conduit operably coupled between a suction manifold and a first fracturing pump, wherein the first conduit includes a first valve;

a second conduit operably coupled between the first fracturing pump and a discharge manifold;

a third conduit operably coupled between the first conduit and a fluid source;

a first configuration in which:

the first valve is or remains in a state that permits communication of hydraulic fracturing fluid from the suction manifold to the first fracturing pump via the first conduit; and the hydraulic fracturing fluid is communicated from the suction manifold to the first fracturing pump via the first conduit, including the first valve, and from the first fracturing pump to the discharge manifold via the second conduit;

and a second configuration in which:

the first valve is or remains in a state that prevents communication of the hydraulic fracturing fluid from the suction manifold to the first fracturing pump via the first conduit; and another fluid is communicated from the fluid source to the third conduit operably coupled between the first conduit and the fluid source, from the third conduit to the first fracturing pump via the first conduit, and from the first fracturing pump to the second conduit.

2. The system of claim 1, further comprising:

the suction manifold;

the discharge manifold; and the first fracturing pump.

3. The system of claim 1, wherein the third conduit includes a second valve, wherein, in the first configuration, the second valve is or remains in a state that prevents communication of the another fluid from the fluid source to the first conduit via the third conduit, and wherein, in the second configuration, the second valve is or remains in a state that permits communication of the another fluid from the fluid source to the first conduit via the third conduit.

4. The system of claim 1, wherein communicating the another fluid from the fluid source to the third conduit, from the third conduit to the first fracturing pump via the first conduit, and from the first fracturing pump to the second conduit, in the second configuration, primes the first fracturing pump.

5. The system of claim 1, further comprising:

a fourth conduit operably coupled between the suction manifold and a second fracturing pump, wherein the fourth conduit includes a second valve;

a fifth conduit operably coupled between the second fracturing pump and the discharge manifold;

a sixth conduit operably coupled between the fourth conduit and the fluid source;

a third configuration in which:

the second valve is or remains in a state that permits communication of the hydraulic fracturing fluid from the suction manifold to the second fracturing pump via the fourth conduit; and the hydraulic fracturing fluid is communicated from the suction manifold to the second fracturing pump via the fourth conduit, including the second valve, and the hydraulic fracturing fluid is communicated from the second fracturing pump to the discharge manifold via the fifth conduit;

and a fourth configuration in which:

the second valve is or remains in a state that prevents communication of the hydraulic fracturing fluid from the suction manifold to the second fracturing pump via the fourth conduit; and the another fluid is communicated from the fluid source to the sixth conduit operably coupled between the fourth conduit and the fluid source, from the sixth conduit to the second fracturing pump via the fourth conduit, and from the second fracturing pump to the fifth conduit.

6. The system of claim 1, further comprising:

a suction flow component via which a suction fitting is detachably coupled to the first conduit, the suction fitting being operably coupled to the first fracturing pump, and the suction flow component being operably coupled to the first conduit, opposite the suction manifold; and a discharge flow component via which a discharge fitting is detachably coupled to the second conduit, the discharge fitting being operably coupled to the first fracturing pump, and the discharge flow component being operably coupled to the second conduit, opposite the discharge manifold.

7. The system of claim 6, further comprising:

the suction fitting;

the discharge fitting; and the first fracturing pump.

8. The system of claim 6, further comprising one or more actuators adapted to effect relative movement between:

the suction flow component and the suction fitting to detachably couple the suction fitting to the first conduit; and/or the discharge flow component and the discharge fitting to detachably couple to the discharge fitting to the second conduit.

9. A method, comprising:

communicating hydraulic fracturing fluid from a suction manifold to a first fracturing pump via a first conduit, and from the first fracturing pump to a discharge manifold via a second conduit, the first conduit being operably coupled between the suction manifold and the first fracturing pump, the first conduit including a first valve via which the hydraulic fracturing fluid is communicated from the suction manifold to the first fracturing pump, the first valve being or remaining in a state that permits said communication of the hydraulic fracturing fluid from the suction manifold to the first fracturing pump via the first conduit, and the second conduit being operably coupled between the first fracturing pump and the discharge manifold;

and communicating another fluid from a fluid source to a third conduit, from the third conduit to the first fracturing pump via the first conduit, and from the first fracturing pump to the second conduit, the third conduit being operably coupled between the first conduit and the fluid source, and the first valve being or remaining in a state that prevents communication of the hydraulic fracturing fluid from the suction manifold to the first fracturing pump via the first conduit during the communication of the another fluid from the third conduit to the first fracturing pump via the first conduit.

10. The method of claim 9, wherein the third conduit includes a second valve via which the another fluid is communicated from the fluid source to the first conduit, the second valve being or remaining in a state that permits said communication of the another fluid from the fluid source to the first conduit, and the second valve being or remaining in a state that prevents communication of the another fluid from the fluid source to the first conduit via the third conduit during the communication of the hydraulic fracturing fluid from the suction manifold to the first fracturing pump via the first conduit.

11. The method of claim 9, wherein the communication of the another fluid from the fluid source to the third conduit, from the third conduit to the first fracturing pump via the first conduit, and from the first fracturing pump to the second conduit primes the first fracturing pump.

12. The method of claim 9, further comprising:

communicating the hydraulic fracturing fluid from the suction manifold to a second fracturing pump via a fourth conduit, and from the second fracturing pump to the discharge manifold via a fifth conduit, the fourth conduit being operably coupled between the suction manifold and the second fracturing pump, the fourth conduit including a second valve via which the hydraulic fracturing fluid is communicated from the suction manifold to the second fracturing pump, the second valve being or remaining in a state that permits said communication of the hydraulic fracturing fluid from the suction manifold to the second fracturing pump via the fourth conduit, and the fifth conduit being operably coupled between the second fracturing pump and the discharge manifold;

and/or communicating the another fluid from the another fluid source to a sixth conduit, from the sixth conduit to the second fracturing pump via the fourth conduit, and from the second fracturing pump to the fifth conduit, the sixth conduit being operably coupled between the fourth conduit and the fluid source, and the second valve being or remaining in a state that prevents communication of the hydraulic fracturing fluid from the suction manifold to the second fracturing pump via the fourth conduit during the communication of the another fluid from the sixth conduit to the second fracturing pump via the fourth conduit.

13. The method of claim 9, further comprising:

detachably coupling a suction fitting to the first conduit via a suction flow component, the suction fitting being operably coupled to the first fracturing pump, and the suction flow component being operably coupled to the first conduit, opposite the suction manifold; and detachably coupling a discharge fitting to the second conduit via a discharge flow component, the discharge fitting being operably coupled to the first fracturing pump, and the discharge flow component being operably coupled to the second conduit, opposite the discharge manifold.

14. The method of claim 13, wherein detachably coupling the suction fitting to the first conduit via the suction flow component comprises effecting relative movement between the suction flow component and the suction fitting using one or more actuators; and/or wherein detachably coupling the discharge fitting to the second conduit via the discharge flow component comprises effecting relative movement between the discharge flow component and the discharge fitting using the one or more actuators.

15. An apparatus, comprising:

a non-transitory computer readable medium; and a plurality of instructions stored on the non-transitory computer readable medium and executable by one or more processors to implement the following steps:

communicating hydraulic fracturing fluid from a suction manifold to a first fracturing pump via a first conduit, and from the first fracturing pump to a discharge manifold via a second conduit, the first conduit being operably coupled between the suction manifold and the first fracturing pump, the first conduit including a first valve via which the hydraulic fracturing fluid is communicated from the suction manifold to the first fracturing pump, the first valve being or remaining in a state that permits said communication of the hydraulic fracturing fluid from the suction manifold to the first fracturing pump via the first conduit, and the second conduit being operably coupled between the first fracturing pump and the discharge manifold;

and communicating another fluid from a fluid source to a third conduit, from the third conduit to the first fracturing pump via the first conduit, and from the first fracturing pump to the second conduit, the third conduit being operably coupled between the first conduit and the fluid source, and the first valve being or remaining in a state that prevents communication of the hydraulic fracturing fluid from the suction manifold to the first fracturing pump via the first conduit during the communication of the another fluid from the third conduit to the first fracturing pump via the first conduit.

16. The apparatus of claim 15, wherein the third conduit includes a second valve via which the another fluid is communicated from the fluid source to the first conduit, the second valve being or remaining in a state that permits said communication of the another fluid from the fluid source to the first conduit, and the second valve being or remaining in a state that prevents communication of the another fluid from the fluid source to the first conduit via the third conduit during the communication of the hydraulic fracturing fluid from the suction manifold to the first fracturing pump via the first conduit.

17. The apparatus of claim 15, wherein the communication of the another fluid from the fluid source to the third conduit, from the third conduit to the first fracturing pump via the first conduit, and from the first fracturing pump to the second conduit primes the first fracturing pump.

18. The apparatus of claim 15, wherein the instructions are executable by the one or more processors to implement the following additional steps:

communicating the hydraulic fracturing fluid from the suction manifold to a second fracturing pump via a fourth conduit, and from the second fracturing pump to the discharge manifold via a fifth conduit, the fourth conduit being operably coupled between the suction manifold and the second fracturing pump, the fourth conduit including a second valve via which the hydraulic fracturing fluid is communicated from the suction manifold to the second fracturing pump, the second valve being or remaining in a state that permits said communication of the hydraulic fracturing fluid from the suction manifold to the second fracturing pump via the fourth conduit, and the fifth conduit being operably coupled between the second fracturing pump and the discharge manifold; and/or communicating the another fluid from the another fluid source to a sixth conduit, from the sixth conduit to the second fracturing pump via the fourth conduit, and from the second fracturing pump to the fifth conduit, the sixth conduit being operably coupled between the fourth conduit and the fluid source, and the second valve being or remaining in a state that prevents communication of the hydraulic fracturing fluid from the suction manifold to the second fracturing pump via the fourth conduit during the communication of the another fluid from the sixth conduit to the second fracturing pump via the fourth conduit.

19. The apparatus of claim 15, wherein the instructions are executable by the one or more processors to implement the following additional steps:

detachably coupling a suction fitting to the first conduit via a suction flow component, the suction fitting being operably coupled to the first fracturing pump, and the suction flow component being operably coupled to the first conduit, opposite the suction manifold; and detachably coupling a discharge fitting to the second conduit via a discharge flow component, the discharge fitting being operably coupled to the first fracturing pump, and the discharge flow component being operably coupled to the second conduit, opposite the discharge manifold.

20. The apparatus of claim 19, wherein detachably coupling the suction fitting to the first conduit via the suction flow component comprises effecting relative movement between the suction flow component and the suction fitting using one or more actuators; and/or wherein detachably coupling the discharge fitting to the second conduit via the discharge flow component comprises effecting relative movement between the discharge flow component and the discharge fitting using the one or more actuators.

* * * * *